US007491686B2

(12) United States Patent
Barthel et al.

(10) Patent No.: US 7,491,686 B2
(45) Date of Patent: Feb. 17, 2009

(54) DETERGENT OR CLEANING AGENT

(75) Inventors: Wolfgang Barthel, Langenfeld (DE); Arno Düffels, Dusseldorf (DE); Salvatore Fileccia, Oberhausen (DE); Ulf Arno Timmann, Cologne (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 11/738,084

(22) Filed: Apr. 20, 2007

(65) Prior Publication Data

US 2007/0244026 A1 Oct. 18, 2007

Related U.S. Application Data

(63) Continuation of application No. PCT/EP2005/011063, filed on Oct. 14, 2005.

(30) Foreign Application Priority Data

Oct. 22, 2004 (DE) ..... 10 2004 051 619

(51) Int. Cl.
*C11D 17/00* (2006.01)

(52) U.S. Cl. ..... 510/446; 510/224; 510/298; 510/475

(58) Field of Classification Search ..... 510/446, 510/224, 298, 475
See application file for complete search history.

(56) References Cited

U.S. PATENT DOCUMENTS

| | | | | |
|---|---|---|---|---|
| 6,251,848 | B1 * | 6/2001 | Holderbaum et al. | 510/446 |
| 6,727,213 | B2 * | 4/2004 | Waschenbach et al. | 510/224 |
| 6,870,006 | B2 * | 3/2005 | Cavalli et al. | 525/123 |
| 6,992,056 | B1 * | 1/2006 | Haerer et al. | 510/446 |
| 7,205,266 | B2 | 4/2007 | Holderbaum et al. | |
| 2003/0050206 | A1 | 3/2003 | Waschenbach et al. | |
| 2003/0166493 | A1 * | 9/2003 | Holderbaum et al. | 510/445 |
| 2003/0186828 | A1 * | 10/2003 | Holderbaum et al. | 510/224 |
| 2005/0153863 | A1 * | 7/2005 | Corominas | 510/446 |
| 2005/0153864 | A1 * | 7/2005 | Corominas | 510/446 |
| 2006/0094634 | A1 * | 5/2006 | Jekel et al. | 510/446 |
| 2006/0194708 | A1 * | 8/2006 | Barthel et al. | 510/337 |

FOREIGN PATENT DOCUMENTS

| | | | |
|---|---|---|---|
| CA | 2299926 | | 9/2000 |
| EP | 1256623 | | 11/2002 |
| EP | 1314654 | | 5/2003 |
| WO | WO0052127 | | 9/2000 |
| WO | WO0149815 | A1 * | 7/2001 |
| WO | WO0183657 | | 11/2001 |
| WO | WO0226926 | | 4/2002 |
| WO | WO02085736 | | 10/2002 |
| WO | WO2004085592 | A1 * | 10/2004 |

* cited by examiner

*Primary Examiner*—Lorna M Douyon
(74) *Attorney, Agent, or Firm*—John S. Child, Jr.

(57) ABSTRACT

Triphasic or multiphasic dosage units for washing or cleaning compositions, comprising at least two washing or cleaning composition shaped bodies, each of which has at least one filled cavity, characterized in that the shaped bodies are adhesively bonded to one another such that the dosage unit has at least two differently filled cavities on its surface, are suitable for the combined formulation of solid and liquid or free-flowing washing or cleaning compositions in one dosage unit.

19 Claims, No Drawings

DETERGENT OR CLEANING AGENT

CROSS-REFERENCE TO RELATED APPLICATIONS

This application is a continuation under 35 U.S.C. § 365 and 35 U.S.C. § 120 of International Application No. PCT/EP2005/011063, filed Oct. 14, 2005. This application also claims priority under 35 U.S.C. § 119 of German Application No. DE 10 2004 051 619.7, filed Oct. 22, 2004. Each application is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention lies in the field of washing or cleaning compositions. In particular, the present invention relates to dosage units for washing or cleaning compositions.

Washing or cleaning compositions are nowadays available to the consumer in various supply forms. In addition to washing powders and granules, this range also includes, for example, detergent concentrates in the form of extruded or tableted compositions. These solid, concentrated and compacted supply forms feature reduced volume per dosage unit and hence reduce the costs for packaging and transport. The washing or cleaning composition tablets, in particular, additionally satisfy the wish of the consumer for simple dosage. The corresponding compositions have been described comprehensively in the prior art. In addition to the advantages cited, compacted washing or cleaning compositions, however, also have a series of disadvantages. Tableted supply forms, in particular, owing to their high compaction, frequently feature retarded decomposition and hence retarded release of their ingredients. To solve this "conflict" between sufficient tablet hardness and short decomposition times, the patent literature discloses numerous technical solutions, and reference shall be made at this point by way of example to the use of so-called tablet disintegrants. These disintegration accelerants are added to the tablets in addition to the washing- or cleaning-active substances, but in themselves generally do not have any washing- or cleaning-active properties and in this way increase the complexity and the costs of these compositions. A further disadvantage of the tableting of active substance mixtures, especially washing- or cleaning-active substance-containing mixtures, is the inactivation of the active substances present as a result of the compacting pressure which occurs in the tableting. An inactivation of the active substances can also be effected by chemical reaction owing to the increased contact surfaces of the ingredients resulting from the tableting.

As an alternative to the above-described particulate or compacted washing or cleaning compositions, solid or liquid washing or cleaning compositions which have water-soluble or water-dispersible packaging have increasingly been described in the last few years. Like the tablets, these compositions feature simplified dosage, since they can be dosed together with the outer packaging into the washing machine or the machine dishwasher, and, on the other hand, they simultaneously also enable the formulation of liquid or pulverulent washing or cleaning compositions which feature better dissolution and more rapid activity compared to the compactates.

(2) Description of Related Art, Including Information Disclosed Under 37 C.F.R. §§ 1.97 and 1.98

For example, EP 1 314 654 A2 (Unilever) discloses a dome-shaped pouch with a receiving chamber which comprises a liquid.

WO 01/83657 A2 (Procter & Gamble), in contrast, provides pouches which comprise two particulate solids, each of which are present in fixed regions and do not mix with one another, in a receiving chamber.

In addition to the packages which have only one receiving chamber, the prior art also discloses supply forms which comprise more than one receiving chamber or more than one formulation type.

The European application EP 1 256 623 A1 (Procter & Gamble) provides a kit composed of at least two pouches with different composition and different appearance. The pouches are present separately from one another and not as a compact individual product.

A process for producing multichamber pouches by adhesive-bonding of two individual chambers is described by the international application WO 02/85736 A1 (Reckitt Benckiser).

BRIEF SUMMARY OF THE INVENTION

It was an object of the present application to provide a process for producing washing or cleaning compositions which enables the combined formulation of solid and liquid or free-flowing washing or cleaning compositions in mutually separate regions of a compact dosage unit. The process end product should be notable for an attractive appearance.

This object is achieved by a combined dosage unit composed of filled washing or cleaning composition shaped bodies.

BRIEF DESCRIPTION OF THE SEVERAL VIEWS OF THE DRAWING(S)

Not Applicable

DETAILED DESCRIPTION OF THE INVENTION

The present application, therefore, firstly provides a triphasic or multiphasic dosage unit for washing or cleaning compositions, comprising at least two washing or cleaning composition shaped bodies, each of which has at least one filled cavity, characterized in that the shaped bodies are adhesively bonded to one another such that the dosage unit has at least two differently filled cavities on its surface.

The shaped bodies used in the inventive compositions are preferably compacted, preferably tableted, or extruded or cast shaped bodies. However, particular preference is given in the context of the present application to tableted shaped bodies.

Washing or cleaning composition tablets are produced in the manner known to those skilled in the art by compressing particulate starting substances. To produce the tablets, the premixture is compacted in a die between two punches to form a solid compact. This operation, which is referred to below as tableting for short, divides into four sections: dosage, compaction (elastic deformation), plastic deformation and expulsion. The tableting is preferably effected on rotary tableting presses.

In the case of tableting with rotary tableting presses, it has been found to be advantageous to perform the tableting with minimum weight deviations of the tablet. In this way, it is also possible to reduce the hardness variations of the tablet. Low weight variations can be achieved in the following way:

use of plastic inlays having low thickness tolerances
low rotational speed of the rotor
large filling shoe
adjustment of the rotational speed of the filling shoe vane to the rotational speed of the rotor
filling shoe with constant powder height
decoupling of filling shoe and powder reservoir.

To reduce caking on the punches, it is possible to use all anti-adhesion coatings known from the prior art. Plastic coatings, plastic inlays or plastic punches are particularly advantageous. Rotary punches have also been found to be advantageous, in which case upper and lower punches should be designed so as to be rotatable if possible. In the case of rotating punches, it is generally possible to dispense with a plastic inlay. Here, the punch surfaces should be electropolished.

Processes preferred in the context of the present invention are characterized in that the compression is effected at pressures of from 0.01 to 50 $kNcm^{-2}$, preferably from 0.1 to 40 $kNcm^{-2}$ and, in particular, from 1 to 25 $kNcm^{-2}$.

The individual phases of biphasic or multiphasic tablets are preferably arranged in layers. The weight ratio of the phase with the lowest proportion by weight of the tablet is preferably at least 50% by weight, preferentially at least 10% by weight and, in particular, at least 20% by weight. The proportion by weight of the phase with the highest proportion by weight in the tablet in biphasic tablets is preferably not more than 90% by weight, preferentially not more than 80% by weight and, in particular, between 55 and 70% by weight. In triphasic tablets, the proportion by weight of the phase with the highest proportion by weight in the tablet is preferably not more than 80% by weight, preferentially not more than 70% by weight and, in particular, between 40 and 60% by weight.

In a further preferred embodiment of the inventive washing or cleaning composition shaped bodies, the tablet has an onionskin-like structure. In such a tablet, at least one inner layer is surrounded completely by at least one outer layer.

In the context of the present invention, the term "cavity" indicates either depressions or apertures or holes which pass through the shaped body and join two sides of the shaped body, preferably opposite sides of the shaped body, for example, the bottom and top surface of the shaped body, to one another.

The shape of the cavity, which is preferably a depression, can be selected freely, preference being given to tablets in which at least one depression has a concave, convex, cubic, tetragonal, orthorhombic, cylindrical, spherical, cylinder segment-like, disk-shaped, tetrahedral, dodecahedral, octahedral, conical, pyramidal, ellipsoidal, pentagonally, heptagonally and octagonally prismatic, and rhombohedral shape. It is also possible to realize entirely irregular depression shapes, such as arrow or animal shapes, trees, clouds, etc. As in the case of the base shaped bodies too, preference is given to depressions with rounded corners and edges or with rounded corners and chamfered edges. The bottom surface of the depression may be planar or tilted.

In a particularly preferred embodiment, the cavity is an aperture which connects two opposite sides of the shaped body to one another. A corresponding shaped body can be referred to as an annulus. The opening surfaces of the aperture in the surface of this annulus may have the same size, but may also differ with regard to their size. When the shaped body used is a tablet, the shaped body with such an aperture corresponds to a so-called ring tablet. Particular preference is given to using such shaped bodies with an aperture, in which the opening surfaces of the aperture on the opposite sides of the shaped body, based on the larger of the two opening surfaces, differ by less than 80%, preferably by less than 60%, preferentially by less than 40%, more preferably by less than 20% and, in particular, by less than 10%. Particular preference is given to using ring tablets in which the opening surfaces of the aperture have the same size. The cross section of the aperture may be angular or round. Cross sections having one, two, three, four, five, six or more corners are realizable, but particular preference is given in the context of the present application to those shaped bodies which have an aperture without corners, preferably an aperture having a round or oval cross section. "Cross section" refers to a surface which is at right angles to a straight connecting line between the centers of the two opposite opening surfaces of the shaped body.

Of course, the shaped body may also have more than one cavity. Particular preference is given in the context of the present application to shaped bodies having two, three, four, five, six, seven, eight, nine, ten, eleven, twelve or more cavities. When the shaped body has more than one cavity, these cavities may either be the above-described depressions or the above-described apertures. Particular preference is given in the context of the present application to shaped bodies which have more than one cavity, at least one of the cavities being a depression and at least one other of the cavities being an aperture.

The volume of the cavity is preferably between 0.1 and 20 ml, preferably between 0.2 and 15 ml, more preferably between 1 and 10 ml and, in particular, between 2 and 7 ml.

The filled washing or cleaning composition shaped bodies are adhesively bonded to one another. The adhesives used are preferably solvents and/or an organic polymer.

Further preferred adhesives are hotmelt adhesives, especially water-soluble hotmelt adhesives, comprising a) from 40 to 70% by weight of at least one homo- or copolymer with free carboxylic acid groups, based on ethylenically unsaturated monomers (component A),
b) from 15 to 45% by weight of at least one water-soluble or water-dispersible polyurethane (component B) and
c) from 10 to 45% by weight of at least one inorganic or organic base (component C), and from 0 to 20% by weight of further additives, the sum of the components adding up to 100% by weight.

In a further preferred embodiment, the adhesive comprises one or more water-soluble polymer(s), preferably a material from the group of (optionally acetalized) polyvinyl alcohol (PVAL), polyvinylpyrrolidone, polyethylene oxide, gelatin, cellulose, and derivatives thereof and mixtures thereof.

The adhesive used for the adhesive bond is preferably water-soluble. Inventive dosage units produced using a water-soluble adhesion promoter feature improved disintegration properties and enhanced washing and cleaning performance compared to conventional dosage units of the same volume.

As described, the adhesively bonded shaped bodies used may be either depression shaped bodies or annular shaped bodies. When two depression shaped bodies each having an orifice on their surface are bonded to one another, the adhesive bond can be effected only to the extent that the orifice of one shaped body is not sealed by the adhesively bonded second shaped body. Suitable faces for the adhesive bond are, for example, accordingly the bottom or side faces of the shaped bodies. When annular shaped bodies are bonded to a depression shaped body or a further annular shaped body to give the inventive dosage unit, the adhesive bond can seal one of the orifices of the annular shaped body; in each case, the resulting dosage unit will have two orifices on its upper side.

Particularly preferred dosage units comprise two depression tablets which are adhesively bonded to one another along their bottom faces. In these dosage units, the filled cavities are separated from one another by the bottom faces of the particular depression tablets.

Particular preference is further given to dosage units comprising a ring tablet and a depression tablet which are adhesively bonded to one another along the bottom face of the depression tablet and an orifice face of the ring tablet. In these dosage units, the filled cavities are separated from one another by the bottom face of the depression tablet used.

A further preferred dosage unit comprises two ring tablets which are adhesively bonded to one another along their bottom faces to form a combined ring tablet. In these depression tablets, the two filled cavities are not separated from one another. Nonetheless, a separation of the cavities, for example, by means of a water-soluble film, is of course also possible here.

The shaped bodies adhesively bonded to one another preferably have a comparable shaped body volume. Preference is given in accordance with the invention to those dosage units in which the volume of the shaped bodies adhesively bonded to one another, based on the volume of the shaped body with the smaller volume, differs by not more than 400% by volume, preferably by not more than 200% by volume, more preferably by not more than 100% by volume and especially by not more than 50% by volume.

The shaped bodies adhesively bonded to one another also preferably have a comparable shaped body weight. Preference is given in accordance with the invention to those dosage units in which the weight of the shaped bodies adhesively bonded to one another, based on the weight of the shaped body with the lower weight, differs by not more than 400% by weight, preferably by not more than 200% by weight, more preferably by not more than 100% by weight and especially by not more than 50% by weight.

The at least two cavities encompassed by the inventive dosage unit have a filling. For the filling, liquid and also solid substances or substance mixtures are suitable.

With preference, the cavities are filled with free-flowing washing- and cleaning-active formulations, preferably liquid(s), especially melts, and/or gel(s) and/or powders and/or granule(s) and/or extrudate(s) and/or compactate(s).

In the present application, the term "liquid" denotes substances or substance mixtures, and equally solutions or suspensions which are present in the liquid state of matter.

Powder is a general term for a form of comminution of solid substances and/or substance mixtures which is obtained by comminution, i.e., trituration or grinding in a mortar (pulverizing), grinding in mills, or as a consequence of atomization or freeze-drying. A particularly fine division is often known as atomization or micronization; the corresponding powders are referred to as micropowders.

According to particle size, a rough division of the powders into coarse, fine and ultrafine powders is customary; pulverulent bulk materials are classified more precisely via their apparent density and by sieve analysis. However, powders preferred in the context of the present application have lower particle sizes below 5,000 μm, preferably less than 3,000 μm, more preferably less than 1,000 μm, even more preferably between 50 and 1,000 μm and, in particular, between 100 and 800 μm.

Powders can be compacted and agglomerated by extrusion, pressing, rolling, briqueting, pelletizing and related processes. Any method known in the prior art for agglomerating particulate mixtures is suitable in principle for preparing the solids present in the inventive compositions. Agglomerates used as solid(s) with preference in the context of the present invention are, in addition to the granules, the compactates and extrudates.

Granules refer to accumulations of small granule particles. A granule particle is an asymmetric aggregate of powder particles. Granulation processes are described widely in the prior art. Granules can be produced by wet granulation, by dry granulation or compaction, and by melt solidification granulation.

The most commonly used granulation technique is wet granulation, since this technique is subject to the fewest restrictions and leads the most reliably to granules with favorable properties. Wet granulation is effected by moistening the powder mixtures with solvents and/or solvent mixtures and/or solutions of binders and/or solutions of adhesives, and is preferably performed in mixers, fluidized beds or spray towers, in which case said mixers may be equipped, for example, with stirring and kneading tools. However, it is also possible to use combinations of fluidized bed(s) and mixer(s) for the granulation, or combinations of various mixers. Depending on the starting material and the product properties desired, the granulation is effected under the action of low to high shear forces.

When the granulation is effected in a spray tower, the starting materials used may, for example, be melts (melt solidification) or preferably aqueous slurries (spray-drying) of solid substances, which are sprayed in at the top of a tower in defined particle size, solidify or dry in free fall and are obtained as granule at the bottom of the tower. Melt solidification is suitable generally particularly for the shaping of low-melting substances which are stable in the region of the melting point (for example, urea, ammonium nitrate and various formulations such as enzyme concentrates, medicaments, etc.); the corresponding granules are also referred to as prills. Spray drying is used particularly for the production of washing compositions or washing composition constituents.

Further agglomeration techniques described in the prior art are extruder or perforated roll granulations, in which powder mixtures optionally admixed with granulation fluid are deformed plastically in the course of pressing through perforated disks (extrusion) or on perforated rolls. The products of the extruder granulation are also referred to as extrudates.

Particular preference is given to dosage units, characterized in that at least one cavity is filled with a free-flowing substance, preferably a particulate substance or a liquid.

Particular preference is likewise given to dosage units, characterized in that at least one cavity is filled with a liquid, at least one further cavity with a solid.

The table which follows gives an overview of a series of preferred inventive dosage units. The quantitative data are each based on the total weight of the fillings of cavity 1 or cavity 2.

| Shaped body 1 | Shaped body 2 | Cavity 1 | Cavity 2 |
|---|---|---|---|
| depression tablet | depression tablet | liquid | powder, granule or extrudate |
| depression tablet | ring tablet | liquid | powder, granule or extrudate |
| depression tablet | depression tablet | liquid with from 10 to 90% by weight of nonionic surfactant and preferably from 10 to 50% by weight of organic solvent | powder, granule or extrudate with from 1 to 100% by weight of bleach |
| depression tablet | depression tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | depression tablet | liquid with from 10 to 90% by weight of nonionic surfactant and preferably from 10 to 50% by weight of organic solvent | powder, granule or extrudate with from 0.1 to 100% by weight of enzyme |
| depression tablet | depression tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of cationic or amphoteric polymers |
| depression tablet | ring tablet | liquid with from 10 to 90% by weight of nonionic surfactant and preferably from 10 to 50% by weight of organic solvent | powder, granule or extrudate with from 1 to 100% by weight of bleach |
| depression tablet | ring tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | ring tablet | liquid with from 10 to 90% by weight of nonionic surfactant and preferably from 10 to 50% by weight of organic solvent | powder, granule or extrudate with from 1 to 100% by weight of enzyme |
| depression tablet | ring tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of cationic or amphoteric polymer |

-continued

| Shaped body 1 | Shaped body 2 | Cavity 1 | Cavity 2 |
|---|---|---|---|
| depression tablet | depression tablet | liquid with from 10 to 90% by weight of nonionic surfactant and preferably from 10 to 50% by weight of organic solvent | powder, granule or extrudate with from 1 to 100% by weight of bleach |
| depression tablet | depression tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | depression tablet | liquid with from 10 to 90% by weight of nonionic surfactant and preferably from 10 to 50% by weight of organic solvent | powder, granule or extrudate with from 1 to 100% by weight of enzyme |
| depression tablet | depression tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of cationic or amphoteric polymer |
| depression tablet | ring tablet | liquid with from 10 to 90% by weight of nonionic surfactant and preferably from 10 to 50% by weight of organic solvent | powder, granule or extrudate with from 1 to 100% by weight of bleach |
| depression tablet | ring tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | ring tablet | liquid with from 10 to 90% by weight of nonionic surfactant and preferably from 10 to 50% by weight of organic solvent | powder, granule or extrudate with from 1 to 100% by weight of enzyme |
| depression tablet | ring tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of cationic or amphoteric polymer |

-continued

| Shaped body 1 | Shaped body 2 | Cavity 1 | Cavity 2 |
|---|---|---|---|
| depression tablet | depression tablet | liquid with from 10 to 90% by weight of nonionic surfactant and preferably from 10 to 50% by weight of organic solvent | powder, granule or extrudate with from 1 to 100% by weight of bleach |
| depression tablet | depression tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | depression tablet | liquid with from 10 to 90% by weight of nonionic surfactant and preferably from 10 to 50% by weight of organic solvent | powder, granule or extrudate with from 1 to 100% by weight of enzyme |
| depression tablet | depression tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of cationic or amphoteric polymer |
| depression tablet | ring tablet | liquid with from 10 to 90% by weight of nonionic surfactant and preferably from 10 to 50% by weight of organic solvent | powder, granule or extrudate with from 1 to 100% by weight of bleach |
| depression tablet | ring tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | ring tablet | liquid with from 10 to 90% by weight of nonionic surfactant and preferably from 10 to 50% by weight of organic solvent | powder, granule or extrudate with from 1 to 100% by weight of enzyme |
| depression tablet | ring tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of cationic or amphoteric polymer |

-continued

| Shaped body 1 | Shaped body 2 | Cavity 1 | Cavity 2 |
|---|---|---|---|
| depression tablet | depression tablet | liquid with from 10 to 90% by weight of nonionic surfactant and preferably from 10 to 50% by weight of organic solvent | powder, granule or extrudate with from 1 to 100% by weight of bleach |
| depression tablet | depression tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | depression tablet | liquid with from 10 to 90% by weight of nonionic surfactant and preferably from 10 to 50% by weight of organic solvent | powder, granule or extrudate with from 1 to 100% by weight of enzyme |
| depression tablet | depression tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | depression tablet | liquid with from 10 to 90% by weight of nonionic surfactant and preferably from 10 to 50% by weight of organic solvent | powder, granule or extrudate with from 0.1 to 100% by weight of cationic or amphoteric polymer |
| depression tablet | ring tablet | liquid with from 10 to 90% by weight of nonionic surfactant and preferably from 10 to 50% by weight of organic solvent | powder, granule or extrudate with from 1 to 100% by weight of bleach |
| depression tablet | ring tablet | liquid with from 10 to 90% by weight of nonionic surfactant and preferably from 10 to 50% by weight of organic solvent | powder, granule or extrudate with from 1 to 95% by weight of bleach and from 0.1 to 10% by weight of bleach activator |
| depression tablet | ring tablet | liquid with from 10 to 90% by weight of nonionic surfactant and preferably from 10 to 50% by weight of organic solvent | powder, granule or extrudate with from 1 to 100% by weight of enzyme |
| depression tablet | ring tablet | liquid with from 10 to 90% by weight of nonionic surfactant and preferably from 10 to 50% by weight of organic solvent | powder, granule or extrudate with from 0.1 to 100% by weight of glass corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of silver corrosion inhibitor |
| depression tablet | ring tablet | liquid with from 10 to 90% by weight of nonionic surfactant and preferably from 10 to 50% by weight of organic solvent | powder, granule or extrudate with from 0.1 to 100% by weight of cationic or amphoteric polymer |

As can be discerned from this table, particular preference is given to inventive washing or cleaning composition shaped bodies with a liquid surfactant-containing filling. These compositions, especially compositions having a content of disintegration assistant in the preferably tableted shaped body, compared to shaped bodies with a correspondingly increased surfactant content in the shaped body, are notable for very high cleaning performance, improved storage stability and improved processability, especially tabletability of the shaped bodies.

The fillings may be fixed into the cavities in different ways. Procedures preferred in accordance with the invention are

- the fixing of prefabricated shaped bodies, pouches or bags with an adhesive or with a locking, plug-type or snap connection;
- the fixing of solid or liquid substances or substance mixtures by means of an adhesive coating, for example, a solidifying melt or a solidifying gel
- the sealing of the cavity, preferably by means of a water-soluble polymer film.

Preference is given in accordance with the invention to dosage units in which at least one cavity is sealed.

For the fixing of shaped body and sealing element, the shaped body and the sealing element are adhesively bonded to one another. Preference is given to effecting the adhesive bond in spatial proximity to the orifice of the cavity. Particular preference is given to adhesive bonding along a continuous seal seam. This seal seam is realizable by a series of different procedures. However, preference is given to those processes in which the adhesive bond is effected by the action of adhesives and/or solvents and/or compressive or squeezing forces. In the case of heat-sealing too, a continuous seal seam, i.e., a closed seal seam, is particularly preferred. For the heat sealing of shaped bodies and water-soluble films, a series of different tools and processes are available to the person skilled in the art.

In a first preferred embodiment, the heat-sealing is effected by the action of heated sealing tools.

In a second preferred embodiment, the heat-sealing is effected by the action of a laser beam.

In a third preferred embodiment, the heat-sealing is effected by the action of hot air.

With particular preference, the washing or cleaning composition shaped bodies and the sealing element(s) are bonded to one another by a heat-sealed seam.

The above-described inventive compositions or the compositions produced by the above-described process according to the invention comprise washing- and cleaning-active substances, preferably washing- and cleaning-active substances from the group of the builders, surfactants, polymers, bleaches, bleach activators, enzyme, glass corrosion inhibitors, corrosion inhibitors, disintegration assistants, fragrances and perfume carriers. These preferred ingredients will be described in detail below.

Builders.

The builders include especially the zeolites, silicates, carbonates, organic cobuilders and, where there are no ecological objections to their use, also the phosphates.

The finely crystalline, synthetic, bound water-containing zeolite used is preferably zeolite A and/or P. The zeolite P is more preferably Zeolite MAP® (commercial product from Crosfield). Also suitable, however, are zeolite X, and mixtures of A, X and/or P. Also commercially available and usable with preference in accordance with the present invention is, for example, a cocrystal of zeolite X and zeolite A (approximately 80% by weight of zeolite X), which is sold by CONDEA Augusta S.p.A. under the trade name VEGO-BOND AX® and can be described by the formula $$nNa_2O.(1-n)K_2O.Al_2O_3.(2-2.5)SiO_2.(3.5-5.5)\ H_2O.$$

The zeolite may be used either a builder in a granular compound or in a kind of "powdering" of a granular mixture, preferably of a mixture to be compacted, and both ways of incorporating the zeolite into the premixture are typically utilized. Suitable zeolites have an average particle size of less than 10 μm (volume distribution; measurement method: Coulter Counter) and preferably contain from 18 to 22% by weight, in particular, from 20 to 22% by weight, of bound water.

Suitable crystalline, sheet-type sodium silicates have the general formula $NaMSi_xO_{2x+1}.H_2O$ where M is sodium or hydrogen, x is a number from 1.9 to 4, y is a number from 0 to 20, and preferred values for x are 2, 3 or 4. Preferred crystalline sheet silicates of the formula specified are those in which M is sodium and x assumes the values of 2 or 3. In particular, preference is given to both β- and also δ-sodium disilicates $Na_2Si_2O_5.yH_2O$.

With particular preference, especially as a constituent of machine dishwasher detergents, crystalline sheet-type silicates of the general formula $NaMSi_xO_{2x+1}.yH_2O$ are used, where M is sodium or hydrogen, x is a number from 1.9 to 22, preferably from 1.9 to 4, and y is a number from 0 to 33. The crystalline sheet-type silicates of the formula $NaMSi_xO_{2x+1}.yH_2O$ are sold, for example, by Clariant GmbH (Germany) under the trade name Na—SKS. Examples of these silicates are Na—SKS-1 ($Na_2Si_{22}O_{45}.xH_2O$, kenyaite), Na—SKS-2 ($Na_2Si_{14}O_{29}.xH_2O$, magadiite), Na—SKS-3 ($Na_2Si_8O_{17}.xH_2O$) or Na—SKS-4 ($Na_2Si_4O_9.xH_2O$, makatite).

Particularly suitable for the purposes of the present invention are crystalline sheet silicates of the formula $NaMSi_xO_{2x+1}.yH_2O$ in which x is 2. Among these, suitable, in particular, are Na—SKS-5 (α—$Na_2Si_2O_5$), Na—SKS-7 (β—$Na_2Si_2O_5$, natrosilite), Na—SKS-9 ($NaHSi_2O_5.H_2O$), Na—SKS-10 ($NaHSi_2O_5.3H_2O$, kanemite), Na—SKS-11 (t—$Na_2Si_2O_5$) and Na—SKS-13 ($NaHSi_2O_5$), but, in particular, Na—SKS-6 (δ—$Na_2Si_2O_5$).

When the silicates are used as a constituent of machine dishwasher detergents, these compositions preferably comprise a proportion by weight of the crystalline sheet-type silicate of the formula $NaMSi_xO_{2x+1}.yH_2O$ of from 0.1 to 20% by weight, of from 0.2 to 15% by weight and, in particular, from 0.4 to 10% by weight, based in each case on the total weight of these compositions. It is particularly preferred especially when such machine dishwasher detergents have a total silicate content below 7% by weight, preferably below 6% by weight, preferentially below 5% by weight, more preferably below 4% by weight, even more preferably below 3% by weight and, in particular, below 2.5% by weight, this silicate, based on the total weight of the silicate present, being silicate of the general formula $NaMSi_xO_{2x+1}.yH_2O$ preferably to an extent of at least 70% by weight, preferentially to an extent of at least 80% by weight and, in particular, to an extent of at least 90% by weight.

It is also possible to use amorphous sodium silicates having an $Na_2O:SiO_2$ modulus of from 1:2 to 1:3.3, preferably from 1:2 to 1:2.8 and, in particular, from 1:2 to 1:2.6, which have retarded dissolution and secondary washing properties. The retardation of dissolution relative to conventional amorphous sodium silicates may have been brought about in a variety of ways, for example, by surface treatment, compounding, compacting or by overdrying. In the context of this invention, the term "amorphous" also includes "X-ray-amorphous." This means that, in X-ray diffraction experiments, the silicates do not afford any sharp X-ray reflections typical of crystalline substances, but rather yield at best one or more maxima of the scattered X-radiation, which have a width of several degree units of the diffraction angle. However, it may quite possibly lead to even particularly good builder properties if the silicate particles in electron diffraction experiments yield vague or even sharp diffraction maxima. This is to be interpreted such that the products have microcrystalline regions with a size of from 10 to several hundred nm, preference being given to values up to a maximum of 50 nm and, in particular, up to a maximum of 20 nm. Such X-ray-amorphous silicates likewise have retarded dissolution compared with conventional waterglasses. Special preference is given to compacted amorphous silicates, compounded amorphous silicates and over-dried X-ray-amorphous silicates.

In the context of the present invention, it is preferred that this/these silicate(s), preferably alkali metal silicates, more preferably crystalline or amorphous alkali metal disilicates, are present in washing or cleaning compositions in amounts of from 10 to 60% by weight, preferably from 15 to 50% by weight and, in particular, from 20 to 40% by weight, based in each case on the weight of the washing or cleaning composition.

It is of course also possible to use the commonly known phosphates as builder substances, as long as such a use is not to be avoided for ecological reasons. This is especially true for the use of inventive compositions or compositions produced by processes according to the invention as machine dishwasher detergents, which is particularly preferred in the context of the present application. Among the multitude of commercially available phosphates, the alkali metal phosphates, with particular preference for pentasodium triphosphate or pentapotassium triphosphate (sodium tripolyphosphate or potassium tripoly-phosphate), have the greatest significance in the washing and cleaning products industry.

Alkali metal phosphates is the collective term for the alkali metal (especially sodium and potassium) salts of the various phosphoric acids, for which a distinction may be drawn between metaphosphoric acids $(HPO_3)_n$ and orthophosphoric acid $H_3PO_4$, in addition to higher molecular weight representatives. The phosphates combine a number of advantages: they act as alkali carriers, prevent limescale deposits on machine components and lime encrustations in fabrics, and additionally contribute to the cleaning performance.

Suitable phosphates are, for example, sodium dihydrogenphosphate, $NaH_2PO_4$, in the form of the dihydrate (density 1.91 $gcm^{-3}$, melting point 60°) or in the form of the monohydrate (density 2.04 $gcm^{-3}$), disodium hydrogenphosphate (secondary sodium phosphate), $Na_2HPO_4$, which is in anhydrous form or can be used with 2 mol of water (density 2.066 $gcm^{-3}$, loss of water at 95°), 7 mol of water (density 1.68 $gcm^{-3}$, melting point 48° with loss of $5H_2O$) and 12 mol of water (density 1.52 $gcm^{-3}$, melting point 35° with loss of $5H_2O$), but, in particular, trisodium phosphate (tertiary sodium phosphate) $Na_3PO_4$, which can be used as the dodecahydrate, as the decahydrate (corresponding to 19-20% $P_2O_5$) and in anhydrous form (corresponding to 39-40% $P_2O_5$).

A further preferred phosphate is tripotassium phosphate (tertiary or tribasic potassium phosphate), $K_3PO_4$. Preference is further given to tetrasodium diphosphate (sodium pyrophosphate), $Na_4P_2O_7$, which exists in anhydrous form (density 2.534 $gcm^{-3}$, melting point 988°, 880° also reported) and as the decahydrate (density 1.815-1.836 $gcm^{-3}$, melting point 94° with loss of water), and also the corresponding potassium salt, potassium diphosphate (potassium pyrophosphate), $K_4P_2O_7$.

The industrially important pentasodium triphosphate, $Na_5P_3O_{10}$ (sodium tripolyphosphate), is a nonhygroscopic, colorless, water-soluble salt which is anhydrous or crystallizes with $6H_2O$ and has the general formula NaO—[P(O)(ONa)—O]$_n$—Na where n=3. The corresponding potassium salt, pentapotassium triphosphate, $K_5P_3O_{10}$ (potassium tripoly-phosphate), is available commercially, for example, in the form of a 50% by weight solution (>23% $P_2O_5$, 25% $K_2O$). The potassium polyphosphates find wide use in the washing and cleaning products industry. There also exist sodium potassium tripolyphosphates which can likewise be used in the context of the present invention. They are formed, for example, when sodium trimetaphosphate is hydrolyzed with KOH:

$$(NaPO_3)_3+2KOH \rightarrow Na_3K_2P_3O_{10}+H_2O$$

They can be used in accordance with the invention in precisely the same way as sodium tripolyphosphate, potassium tripolyphosphate or mixtures of the two; mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate can also be used in accordance with the invention.

When phosphates are used as washing- or cleaning-active substances in washing or cleaning compositions in the context of the present application, preferred compositions comprise these phosphate(s), preferably alkali metal phosphate(s), more preferably pentasodium triphosphate or pentapotassium triphosphate (sodium tripolyphosphate or potassium tripolyphosphate), in amounts of from 5 to 80% by weight, preferably from 15 to 75% by weight and, in particular, from 20 to 70% by weight, based in each case on the weight of the washing or cleaning composition.

It is especially preferred to use potassium tripolyphosphate and sodium tripolyphosphate in a weight ratio of more than 1:1, preferably more than 2:1, preferentially more than 5:1, more preferably more than 10:1 and especially more than 20:1. It is particularly preferred to use exclusively potassium tripolyphosphate without additions of other phosphates.

Further builders are the alkali carriers. Alkali carriers include, for example, alkali metal hydroxides, alkali metal carbonates, alkali metal hydrogencarbonates, alkali metal sesquicarbonates, the aforementioned alkali metal silicates, alkali metal metasilicates and mixtures of the aforementioned substances, preference being given in the context of this invention to using the alkali metal carbonates, especially sodium carbonate, sodium hydrogencarbonate or sodium sesquicarbonate. Particular preference is given to a builder system comprising a mixture of tripolyphosphate and sodium carbonate. Particular preference is likewise given to a builder system comprising a mixture of tripolyphosphate and sodium carbonate and sodium disilicate.

Owing to their low chemical compatibility with the remaining ingredients of washing or cleaning compositions in comparison with other builder substances, the alkali metal hydroxides are preferably used only in small amounts, preferably in amounts below 10% by weight, preferentially below 6% by weight, more preferably below 4% by weight and, in particular, below 2% by weight, based in each case on the total weight of the washing or cleaning composition. Particular preference is given to compositions which, based on their total weight, contain less than 0.5% by weight of and, in particular, no alkali metal hydroxides.

Particular preference is given to the use of carbonate(s) and/or hydrogencarbonate(s), preferably alkali metal carbonate(s), more preferably sodium carbonate, in amounts of from 2 to 50% by weight, preferably from 5 to 40% by weight and, in particular, from 7.5 to 30% by weight, based in each case on the weight of the washing or cleaning composition. Particular preference is given to compositions which, based on the weight of the washing or cleaning composition, contain less than 20% by weight, preferably less than 17% by weight, preferentially less than 13% by weight and, in particular, less than 9% by weight of carbonate(s) and/or hydrogencarbonate(s), preferably alkali metal carbonate(s), more preferably sodium carbonate.

Organic cobuilders include, in particular, polycarboxylates/polycarboxylic acids, polymeric polycarboxylates, aspartic acid, polyacetals, dextrins, further organic cobuilders (see below) and phosphonates. These substance classes are described below.

Organic builder substances which can be used are, for example, the polycarboxylic acids usable in the form of their sodium salts, polycarboxylic acids referring to those carboxylic acids which bear more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), as long as such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids themselves may also be used. In addition to their builder action, the acids typically also have the property of an acidifying component and thus also serve to set a lower and milder pH of washing or cleaning compositions. In this connection, particular mention should be made of citric acid, succinic acid, glutaric acid, adipic acid, gluconic acid and any mixtures thereof.

Also suitable as builders are polymeric polycarboxylates; these are, for example, the alkali metal salts of polyacrylic acid or of polymethacrylic acid, for example, those having a relative molecular mass of from 500 to 70,000 g/mol.

In the context of this document, the molar masses specified for polymeric polycarboxylates are weight-average molar masses $M_W$ of the particular acid form, which have always been determined by means of gel-permeation chromatography (GPC) using a UV detector. The measurement was against an external polyacrylic acid standard which, owing to its structural similarity to the polymers under investigation, provides realistic molecular weight values. These figures deviate considerably from the molecular weight data when polystyrenesulfonic acids are used as the standard. The molar masses measured against polystyrenesulfonic acids are generally distinctly higher than the molar masses specified in this document.

Suitable polymers are, in particular, polyacrylates which preferably have a molecular mass of from 2,000 to 20,000 g/mol. Owing to their superior solubility, preference within this group may be given in turn to the short-chain polyacrylates which have molar masses of from 2,000 to 10,000 g/mol and more preferably from 3,000 to 5,000 g/mol.

Also suitable are copolymeric polycarboxylates, especially those of acrylic acid with methacrylic acid and of acrylic acid or methacrylic acid with maleic acid. Copolymers which have been found to be particularly suitable are those of acrylic acid with maleic acid which contain from 50 to 90% by weight of acrylic acid and from 50 to 10% by weight of maleic acid. Their relative molecular mass, based on free acids, is generally from 2,000 to 70,000 g/mol, preferably from 20,000 to 50,000 g/mol and, in particular, from 30,000 to 40,000 g/mol.

The (co)polymeric polycarboxylates can either be used in the form of powders or in the form of aqueous solutions. The (co)polymeric polycarboxylate content of the washing or cleaning compositions is preferably from 0.5 to 20% by weight, in particular, from 3 to 10% by weight.

To improve the water solubility, the polymers may also contain allylsulfonic acids, for example, allyloxybenzenesulfonic acid and methallylsulfonic acid, as monomers.

Also especially preferred are biodegradable polymers composed of more than two different monomer units, for example, those which contain, as monomers, salts of acrylic acid and of maleic acid, and vinyl alcohol or vinyl alcohol derivatives, or those which contain, as monomers, salts of acrylic acid and of 2-alkylallylsulfonic acid, and sugar derivatives.

Further preferred copolymers are those which preferably have, as monomers, acrolein and acrylic acid/acrylic acid salts or acrolein and vinyl acetate.

Further preferred builder substances which should likewise be mentioned are polymeric aminodicarboxylic acids, salts thereof or precursor substances thereof. Particular preference is given to polyaspartic acids or salts thereof.

Further suitable builder substances are polyacetals which can be obtained by reacting dialdehydes with polyolcarboxylic acids which have from 5 to 7 carbon atoms and at least 3 hydroxyl groups. Preferred polyacetals are obtained from dialdehydes such as glyoxal, glutaraldehyde, terephthalaldehyde, and mixtures thereof, and from polyolcarboxylic acids such as gluconic acid and/or glucoheptonic acid.

Further suitable organic builder substances are dextrins, for example, oligomers or polymers of carbohydrates, which can be obtained by partial hydrolysis of starches. The hydrolysis can be carried out by customary, for example, acid-catalyzed or enzyme-catalyzed, processes. The hydrolysis products preferably have average molar masses in the range from 400 to 500,000 g/mol. Preference is given to a polysaccharide having a dextrose equivalent (DE) in the range from 0.5 to 40, in particular, from 2 to 30, where DE is a common measure of the reducing action of a polysaccharide compared to dextrose, which has a DE of 100. It is also possible to use maltodextrins with a DE between 3 and 20 and dry glucose syrups with a DE between 20 and 37, and also yellow dextrins and white dextrins having relatively high molar masses in the range from 2,000 to 30,000 g/mol.

The oxidized derivatives of such dextrins are their reaction products with oxidizing agents which are capable of oxidizing at least one alcohol function of the saccharide ring to the carboxylic acid function.

Oxydisuccinates and other derivatives of disuccinates, preferably ethylenediaminedisuccinate, are also further suitable cobuilders. In this case, ethylenediamine-N,N'-disuccinate (EDDS) is preferably used in the form of its sodium or magnesium salts. Furthermore, in this connection, preference is also given to glyceryl disuccinates and glyceryl trisuccinates. Suitable use amounts in zeolite-containing and/or silicate-containing formulations are from 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and a maximum of two acid groups.

In addition, it is possible to use all compounds which are capable of forming complexes with alkaline earth metal ions as builders.

Surfactants.

The group of the surfactants includes not only the nonionic surfactants but also the anionic, cationic and amphoteric surfactants.

The nonionic surfactants used may be all nonionic surfactants known to those skilled in the art. The preferred surfactants used are low-foaming nonionic surfactants. With particular preference, washing or cleaning compositions, especially cleaning compositions for machine dishwashing, comprise nonionic surfactants, especially nonionic surfactants from the group of the alkoxylated alcohols. The nonionic surfactants used are preferably alkoxylated, advantageously ethoxylated, in particular, primary alcohols having preferably from 8 to 18 carbon atoms and on average from 1 to 12 mol of ethylene oxide (EO) per mole of alcohol in which the alcohol radical may be linear or preferably 2-methyl-branched, or may contain a mixture of linear and methyl-branched radicals, as are typically present in oxo alcohol radicals. However, especially preferred alcohol ethoxylates have linear radicals of alcohols of natural origin having from 12 to 18 carbon atoms, for example, of coconut, palm, tallow fat or oleyl alcohol, and on average from 2 to 8 EO per mole of alcohol. The preferred ethoxylated alcohols include, for example, $C_{12-14}$-alcohols having 3 EO or 4 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3 EO and $C_{12-18}$-alcohol having 5 EO. The degrees of ethoxylation specified are statistical average values which may be an integer or a fraction for a specific product. Preferred alcohol ethoxylates have a narrowed homolog distribution (narrow range ethoxylates, NRE). In addition to these nonionic surfactants, it is also possible to use fatty alcohols having more than 12 EO. Examples thereof are tallow fatty alcohol having 14 EO, 25 EO, 30 EO or 40 EO.

In addition, further nonionic surfactants which may be used are also alkyl glycosides of the general formula $RO(G)_x$ in which R is a primary straight-chain or methyl-branched, in particular, 2-methyl-branched, aliphatic radical having from 8 to 22, preferably from 12 to 18, carbon atoms and G is the symbol which is a glycose unit having 5 or 6 carbon atoms, preferably glucose. The degree of oligomerization x, which specifies the distribution of monoglycosides and oligoglycosides, is any number between 1 and 10; x is preferably from 1.2 to 1.4.

A further class of nonionic surfactants used with preference, which are used either as the sole nonionic surfactant or in combination with other nonionic surfactants, are alkoxylated, preferably ethoxylated or ethoxylated and propoxylated, fatty acid alkyl esters, preferably having from 1 to 4 carbon atoms in the alkyl chain.

Nonionic surfactants of the amine oxide type, for example, N-cocoalkyl-N,N-dimethylamine oxide and N-tallowalkyl-N,N-dihydroxyethylamine oxide, and of the fatty acid alkanolamide type may also be suitable. The amount of these nonionic surfactants is preferably not more than that of the ethoxylated fatty alcohols, in particular, not more than half thereof.

Further suitable surfactants are polyhydroxy fatty acid amides of the formula

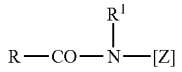

in which R is an aliphatic acyl radical having from 6 to 22 carbon atoms, $R^1$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups. The polyhydroxy fatty acid amides are known substances which can typically be obtained by reductively aminating a reducing sugar with ammonia, an alkylamine or an alkanolamine, and subsequently acylating with a fatty acid, a fatty acid alkyl ester or a fatty acid chloride.

The group of polyhydroxy fatty acid amides also includes compounds of the formula

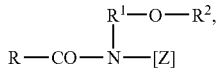

in which R is a linear or branched alkyl or alkenyl radical having from 7 to 12 carbon atoms, $R^1$ is a linear, branched or cyclic alkyl radical or an aryl radical having from 2 to 8 carbon atoms and $R^2$ is a linear, branched or cyclic alkyl radical or an aryl radical or an oxyalkyl radical having from 1 to 8 carbon atoms, preference being given to $C_{1-4}$-alkyl or phenyl radicals, and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a reduced sugar, for example, glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

With particular preference, moreover, surfactants which contain one or more tallow fat alcohols with 20 to 30 EO in combination with a silicone defoamer are used.

Nonionic surfactants from the group of the alkoxylated alcohols, more preferably from the group of the mixed alkoxylated alcohols and, in particular, from the group of the EO-AO-EO nonionic surfactants, are likewise used with particular preference.

Special preference is given to nonionic surfactants which have a melting point above room temperature, particular preference being given to nonionic surfactants having a melting point above 20° C., preferably above 25° C., more preferably between 25 and 60° C. and, in particular, between 26.6 and 43.3° C.

Suitable nonionic surfactants which have melting or softening points in the temperature range specified are, for example, low-foaming nonionic surfactants which may be solid or highly viscous at room temperature. When nonionic surfactants which have a high viscosity at room temperature are used, they preferably have a viscosity above 20 Pas, preferably above 35 Pas and, in particular, above 40 Pas. Nonionic surfactants which have a waxlike consistency at room temperature are also preferred.

Surfactants which are solid at room temperature and are to be used with preference stem from the groups of alkoxylated nonionic surfactants, in particular, the ethoxylated primary alcohols and mixtures of these surfactants with structurally complex surfactants, such as polyoxypropylene/polyoxyethylene/polyoxypropylene ((PO/EO/PO) surfactants). Such (PO/EO/PO) nonionic surfactants are additionally notable for good foam control.

In a preferred embodiment of the present invention, the nonionic surfactant with a melting point above room temperature is an ethoxylated nonionic surfactant which has resulted from the reaction of a monohydroxyalkanol or alkylphenol having from 6 to 20 carbon atoms with preferably at least 12 mol, more preferably at least 15 mol, in particular, at least 20 mol, of ethylene oxide per mole of alcohol or alkylphenol.

A particularly preferred nonionic surfactant which is solid at room temperature is obtained from a straight-chain fatty alcohol having from 16 to 20 carbon atoms ($C_{16-20}$-alcohol), preferably a $C_{18}$-alcohol, and at least 12 mol, preferably at least 15 mol and, in particular, at least 20 mol, of ethylene oxide. Of these, the "narrow range ethoxylates" (see above) are particularly preferred.

With particular preference, ethoxylated nonionic surfactants which have been obtained from $C_{6-20}$-monohydroxyalkanols or $C_{6-20}$-alkylphenols or $C_{16-20}$ fatty alcohols and more than 12 mol, preferably more than 15 mol and, in particular, more than 20 mol of ethylene oxide per mole of alcohol are therefore used.

The room temperature solid nonionic surfactant preferably additionally has propylene oxide units in the molecule. Preferably, such PO units comprise up to 25% by weight, more preferably up to 20% by weight and, in particular, up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules preferably makes up more than 30% by weight, more preferably more than 50% by weight and, in particular, more than 70% by weight, of the total molar mass of such nonionic surfactants. Preferred compositions are characterized in that they comprise ethoxylated and propoxylated nonionic surfactants in which the propylene oxide units in the molecule comprise up to 25% by weight, preferably up to 20% by weight and, in particular, up to 15% by weight, of the total molar mass of the nonionic surfactant.

Further nonionic surfactants which have melting points above room temperature and are to be used with particular preference contain from 40 to 70% of a polyoxypropylene/polyoxyethylene/polyoxypropylene block polymer blend which contains 75% by weight of an inverse block copolymer of polyoxyethylene and polyoxypropylene having 17 mol of ethylene oxide and 44 mol of propylene oxide, and 25% by weight of a block copolymer of polyoxyethylene and polyoxypropylene initiated with trimethylolpropane and containing 24 mol of ethylene oxide and 99 mol of propylene oxide per mole of trimethylolpropane.

Nonionic surfactants which can be used with particular preference are obtainable, for example, under the name Poly Tergent® SLF-18 from Olin Chemicals.

Surfactants of the formula $$R^1O[CH_2CH(CH_3)O]_x[CH_2CH_2O]_yCH_2CH(OH)R^2$$

in which $R^1$ is a linear or branched aliphatic hydrocarbon radical having from 4 to 18 carbon atoms or mixtures thereof, $R^2$ is a linear or branched hydrocarbon radical having from 2 to 26 carbon atoms or mixtures thereof, and x is from 0.5 to 1.5, and y is a value of at least 15 are further particularly preferred nonionic surfactants.

Further nonionic surfactants which can be used with preference are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is from 1 to 30, k and j are from 1 to 12, preferably from 1 to 5. When the value x=2, each $R^3$ in the above formula $R^1O[CH_2CH(R^3)O]_x[CH_2]_kCH(OH)[CH_2]_jOR^2$ may be different. $R^1$ and $R^2$ are preferably linear or branched, saturated or unsaturated, aliphatic or aromatic hydrocarbon radicals having from 6 to 22 carbon atoms, particular preference being given to radicals having from 8 to 18 carbon atoms. For the $R^3$ radical, particular preference is given to H, —$CH_3$ or —$CH_2CH_3$. Particularly preferred values for x are in the range from 1 to 20, in particular, from 6 to 15.

As described above, each $R^3$ in the above formula may be different if x=2. This allows the alkylene oxide unit in the square brackets to be varied. When x is, for example, 3, the $R^3$ radical may be selected so as to form ethylene oxide ($R^3$=H) or propylene oxide ($R^3$=$CH_3$) units which can be joined together in any sequence, for example, (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and it is entirely possible for it to be larger, the scope of variation increasing with increasing x values and embracing, for example, a large number of (EO) groups combined with a small number of (PO) groups, or vice versa.

Particularly preferred terminally capped poly(oxyalkylated) alcohols of the above formula have values of k=1 and j=1, so that the above formula is simplified to $$R^1O[CH_2CH(R^3)O]_xCH_2CH(OH)CH_2OR^2.$$

In the latter formula, $R^1$, $R^2$ and $R^3$ are each as defined above and x is a number from 1 to 30, preferably from 1 to 20 and, in particular, from 6 to 18. Particular preference is given to surfactants in which the $R^1$ and $R^2$ radicals have from 9 to 14 carbon atoms, $R^3$ is H and x assumes values of from 6 to 15.

If the latter statements are summarized, preference is given to the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is from 1 to 30, k and j are from 1 to 12, preferably from 1 to 5, particular preference being given to surfactants of the $$R^1O[CH_2CH(R^3)O]_xCH_2CH(OH)CH_2OR^2$$

type in which x is a number from 1 to 30, preferably from 1 to 20 and, in particular, from 6 to 18.

Particularly preferred nonionic surfactants in the context of the present invention have been found to be low-foaming nonionic surfactants which have alternating ethylene oxide and alkylene oxide units. Among these, preference is given in turn to surfactants having EO-AO-EO-AO blocks, and in each case from one to ten EO and/or AO groups are bonded to one another before a block of the other groups in each case follows. Preference is given here to nonionic surfactants of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

in which $R^1$ is a straight-chain or branched, saturated or mono- or polyunsaturated $C_{6-24}$-alkyl or -alkenyl radical; each $R^2$ or $R^3$ group is independently selected from —$CH_3$, —$CH_2CH_3$, —$CH_2CH_2$—$CH_3$, $CH(CH_3)_2$ and the indices w, x, y, z are each independently integers from 1 to 6.

The preferred nonionic surfactants of the above formula can be prepared by known methods from the corresponding alcohols $R^1$—OH and ethylene oxide or alkylene oxide. The $R^1$ radical in the above formula may vary depending on the origin of the alcohol. When native sources are utilized, the $R^1$ radical has an even number of carbon atoms and is generally unbranched, and preference is given to the linear radicals of alcohols of native origin having from 12 to 18 carbon atoms, for example, from coconut, palm, tallow fat or oleyl alcohol. Alcohols obtainable from synthetic sources are, for example, the Guerbet alcohols or 2-methyl-branched or linear and methyl-branched radicals in a mixture, as are typically present in oxo alcohol radicals. Irrespective of the type of the alcohol used to prepare the nonionic surfactants present in the compositions, preference is given to nonionic surfactants in which $R^1$ in the above formula is an alkyl radical having from 6 to 24, preferably from 8 to 20, more preferably from 9 to 15 and, in particular, from 9 to 11 carbon atoms.

The alkylene oxide unit which is present in the preferred nonionic surfactants in alternation to the ethylene oxide unit is, as well as propylene oxide, especially butylene oxide. However, further alkylene oxides in which $R^2$ and $R^3$ are each independently selected from —$CH_2CH_2$—$CH_3$ and $CH(CH_3)_2$ are also suitable. Preference is given to using nonionic surfactants of the above formula in which $R^2$ and $R^3$ are each a —$CH_3$ radical, w and x are each independently 3 or 4, and y and z are each independently 1 or 2.

In summary, preference is given, in particular, to nonionic surfactants which have a $C_{9-15}$-alkyl radical having from 1 to 4 ethylene oxide units, followed by from 1 to 4 propylene oxide units, followed by from 1 to 4 ethylene oxide units, followed by from 1 to 4 propylene oxide units. In aqueous solution, these surfactants have the required low viscosity and can be used with particular preference in accordance with the invention.

Further nonionic surfactants usable with preference are the terminally capped poly(oxyalkylated)nonionic surfactants of the formula $$R^1O[CH_2CH(R^3)O]_xR^2$$

in which $R^1$ is linear or branched, saturated or unsaturated, aliphatic or aromatic hydrocarbon radicals having from 1 to 30 carbon atoms, $R^2$ is linear or branched, saturated or unsaturated, aliphatic or aromatic hydrocarbon radicals which have from 1 to 30 carbon atoms and preferably have between 1 and 5 hydroxyl groups and are preferably further functionalized with an ether group, $R^3$ is H or a methyl, ethyl, n-propyl, isopropyl, n-butyl, 2-butyl or 2-methyl-2-butyl radical, x is from 1 to 40.

In a particularly preferred embodiment of the present application, $R^3$ in the aforementioned general formula is H. From the group of the resulting terminally capped poly(oxyalkylated) nonionic surfactants of the formula $$R^1O[CH_2CH_2O]_xR^2,$$

preference is given, in particular, to those nonionic surfactants in which $R^1$ is linear or branched, saturated or unsaturated, aliphatic or aromatic hydrocarbon radicals having from 1 to 30 carbon atoms, preferably having from 4 to 20 carbon atoms, $R^2$ is linear or branched, saturated or unsaturated, aliphatic or aromatic hydrocarbon radicals which have from 1 to 30 carbon atoms and preferably have between 1 and 5 hydroxyl groups, and x is from 1 to 40.

Preference is given, in particular, to those terminally capped poly(oxyalkylated) nonionic surfactants which, according to the formula $$R^1O[CH_2CH_2O]_xCH_2CH(OH)R^2,$$

have not only an $R^1$ radical which is linear or branched, saturated or unsaturated, aliphatic or aromatic hydrocarbon radicals having from 1 to 30 carbon atoms, preferably having from 4 to 20 carbon atoms, but also a linear or branched, saturated or unsaturated, aliphatic or aromatic hydrocarbon radical $R^2$ having from 1 to 30 carbon atoms which is adjacent to a monohydroxylated intermediate group —$CH_2CH$(OH)—. In this formula, x is from 1 to 90.

Particular preference is given to nonionic surfactants of the general formula $$R^1O[CH_2CH_2O]_xCH_2CH(OH)R^2,$$

which have not only an $R^1$ radical which is linear or branched, saturated or unsaturated, aliphatic or aromatic hydrocarbon radicals having from 1 to 30 carbon atoms, preferably having from 4 to 22 carbon atoms, but also a linear or branched, saturated or unsaturated, aliphatic or aromatic hydrocarbon radical $R^2$ having from 1 to 30 carbon atoms, preferably from 2 to 22 carbon atoms, which is adjacent to a monohydroxylated intermediate group —$CH_2CH$(OH)— and in which x is from 40 to 80, preferably from 40 to 60.

The corresponding terminally capped poly(oxyalkylated) nonionic surfactants of the above formula can be obtained, for example, by reacting a terminal epoxide of the formula $R^2CH(O)CH_2$ with an ethoxylated alcohol of the formula $R^1O[CH_2CH_2O]_{x-1}CH_2CH_2OH$.

Particular preference is further given to those terminally capped poly(oxyalkylated) nonionic surfactants of the formula $$R^1O[CH_2CH_2O]_x[CH_2CH(CH_3)O]_yCH_2CH(OH)R^2$$

in which $R^1$ and $R^2$ are each independently a linear or branched, saturated or mono- or polyunsaturated hydrocarbon radical having from 2 to 26 carbon atoms, $R^3$ is independently selected from —$CH_3$, —$CH_2CH_3$, —$CH_2CH_2$—$CH_3$, $CH(CH_3)_2$, but preferably —$CH_3$, and x and y are each independently from 1 to 32, particular preference being given to nonionic surfactants with values for x of from 15 to 32 and y of 0.5 and 1.5.

Surfactants of the general formula

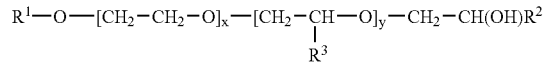

in which $R^1$ and $R^2$ are each independently a linear or branched, saturated or mono- or polyunsaturated hydrocarbon radical having from 2 to 26 carbon atoms, $R^3$ is independently selected from —$CH_3$, —$CH_2CH_3$, —$CH_2CH_2$—$CH_3$, $CH(CH_3)_2$, but preferably —$CH_3$, and x and y are each independently from 1 to 32, are preferred in accordance with the invention, very particular preference being given to nonionic surfactants with values for x of from 15 to 32 and y of 0.5 and 1.5.

The specified carbon chain lengths and degrees of ethoxylation or degrees of alkoxylation of the aforementioned nonionic surfactants constitute statistical averages which may be a whole number or a fraction for a specific product. As a consequence of the preparation process, commercial products of the formulas specified do not usually consist of one individual representative, but rather of mixtures, as a result of which average values and consequently fractions can arise both for the carbon chain lengths and for the degrees of ethoxylation or degrees of alkoxylation.

It will be appreciated that the aforementioned nonionic surfactants may be used not only as individual substances but also as surfactant mixtures of two, three, four or more surfactants. Surfactant mixtures refer not only to mixtures of nonionic surfactants which, in their entirety, fall under one of the above-mentioned general formulas, but also those mixtures which comprise two, three, four or more nonionic surfactants which can be described by different general formulas among those above.

The anionic surfactants used are, for example, those of the sulfonate and sulfate type. Useful surfactants of the sulfonate type are preferably $C_{9-13}$-alkylbenzenesulfonates, olefinsulfonates, i.e., mixtures of alkene- and hydroxyalkanesulfonates, and disulfonates, as are obtained, for example, from $C_{12-18}$-monoolefins with terminal or internal double bond by sulfonation with gaseous sulfur trioxide and subsequent alkaline or acidic hydrolysis of the sulfonation products. Also suitable are alkanesulfonates which are obtained from $C_{12-18}$-alkanes, for example, by sulfochlorination or sulfoxidation with subsequent hydrolysis or neutralization. The esters of α-sulfo fatty acids (ester sulfonates), for example, the α-sulfonated methyl esters of hydrogenated coconut, palm kernel or tallow fatty acids, are also likewise suitable.

Further suitable anionic surfactants are sulfated fatty acid glycerol esters. Fatty acid glycerol esters refer to the mono-, di- and triesters, and mixtures thereof, as are obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having from 6 to 22 carbon atoms, for example, of caproic acid, caprylic acid, capric acid, myristic acid, lauric acid, palmitic acid, stearic acid or behenic acid.

Preferred alk(en)yl sulfates are the alkali metal and, in particular, the sodium salts of the sulfuric monoesters of C12-C18 fatty alcohols, for example, of coconut fatty alcohol, tallow fatty alcohol, lauryl, myristyl, cetyl or stearyl alcohol, or of C10-C20 oxo alcohols and those monoesters of secondary alcohols of these chain lengths. Also preferred are alk(en)yl sulfates of the chain length mentioned which contain a synthetic straight-chain alkyl radical prepared on a petrochemical basis and which have analogous degradation behavior to the equivalent compounds based on fatty chemical raw materials. From the washing point of view, preference is given to the C12-C16-alkyl sulfates and C12-C15-alkyl sulfates, and C14-C15-alkyl sulfates. 2,3-Alkyl sulfates, which can be obtained as commercial products from the Shell Oil Company under the name DAN®, are also suitable anionic surfactants.

Also suitable are the sulfuric monoesters of the straight-chain or branched C7-21-alcohols ethoxylated with 1 to 6 mol of ethylene oxide, such as 2-methyl-branched C9-11-alcohols with on average 3.5 mol of ethylene oxide (EO) or C12-18 fatty alcohols with from 1 to 4 EO. Owing to their high tendency to foam, they are used in cleaning compositions only in relatively small amounts, for example, amounts of from 1 to 5% by weight.

Further suitable anionic surfactants are also the salts of alkylsulfosuccinic acid, which are also referred to as sulfosuccinates or as sulfosuccinic esters and are the monoesters and/or diesters of sulfosuccinic acid with alcohols, preferably fatty alcohols and, in particular, ethoxylated fatty alcohols. Preferred sulfosuccinates contain C8-18 fatty alcohol radicals or mixtures thereof. Especially preferred sulfosuccinates contain a fatty alcohol radical which is derived from ethoxylated fatty alcohols which, considered alone, constitute nonionic surfactants. In this context, particular preference is again given to sulfosuccinates whose fatty alcohol radicals are derived from ethoxylated fatty alcohols with a narrowed homolog distribution. It is also equally possible to use alk(en)ylsuccinic acid having preferably from 8 to 18 carbon atoms in the alk(en)yl chain or salts thereof.

Useful further anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived, in particular, from natural fatty acids, for example, coconut, palm kernel or tallow fatty acids.

The anionic surfactants including the soaps may be present in the form of their sodium, potassium or ammonium salts, and also in the form of soluble salts of organic bases, such as mono-, di- or triethanolamine. The anionic surfactants are preferably present in the form of their sodium or potassium salts, in particular, in the form of the sodium salts.

When the anionic surfactants are a constituent of machine dishwasher detergents, their content, based on the total weight of the compositions, is preferably less than 4% by weight, preferentially less than 2% by weight and most preferably less than 1% by weight. Special preference is given to machine dishwasher detergents which do not contain any anionic surfactants.

Instead of the surfactants mentioned or in conjunction with them, it is also possible to use cationic and/or amphoteric surfactants.

The cationic active substances used may, for example, be cationic compounds of the following formulas:

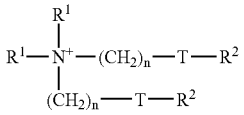

-continued

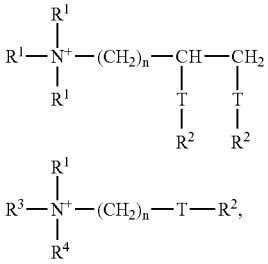

in which each $R^1$ group is independently selected from $C_{1-6}$-alkyl, -alkenyl or -hydroxyalkyl groups; each $R^2$ group is independently selected from $C_{8-28}$-alkyl or -alkenyl groups; $R^3=R^1$ or $(CH_2)_n$-T-$R^2$; $R^4=R^1$ or $R^2$ or $(CH_2)_n$-T-$R^2$; T=—$CH_2$—, —O—CO— or —CO—O— and n is an integer from 0 to 5.

In machine dishwasher detergents, the content of cationic and/or amphoteric surfactants is preferably less than 6% by weight, preferentially less than 4% by weight, even more preferably less than 2% by weight and, in particular, less than 1% by weight. Particular preference is given to machine dishwasher detergents which do not contain any cationic or amphoteric surfactants.

Polymers.

The group of polymers includes, in particular, the washing- or cleaning-active polymers, for example, the rinse aid polymers and/or polymers active as softeners. Generally, not only nonionic polymers but also cationic, anionic and amphoteric polymers can be used in washing or cleaning compositions.

"Cationic polymers" in the context of the present invention are polymers which bear a positive charge in the polymer molecule. This can be realized, for example, by (alkyl)ammonium moieties present in the polymer chain or other positively charged groups. Particularly preferred cationic polymers stem from the groups of the quaternized cellulose derivatives, the polysiloxanes with quaternary groups, the cationic guar derivatives, the polymer dimethyldiallylammonium salts and copolymers thereof with esters and amides of acrylic acid and methacrylic acid, the copolymers of vinylpyrrolidone with quaternized derivatives of dialkylaminoacrylate and -methacrylate, the vinylpyrrolidone-methoimidazolinium chloride copolymers, the quaternized polyvinyl alcohols, or the polymers specified under the INCI designations Polyquaternium 2, Polyquaternium 17, Polyquaternium 18 and Polyquaternium 27.

"Amphoteric polymers" in the context of the present invention have, in addition to a positively charged group in the polymer chain, also negatively charged groups or monomer units. These groups may, for example, be carboxylic acids, sulfonic acids or phosphonic acids.

Preferred washing or cleaning compositions, especially preferred machine dishwasher detergents, are characterized in that they comprise a polymer a) which contains monomer units of the formula $R^1R^2C{=}CR^3R^4$ in which each $R^1$, $R^2$, $R^3$, $R^4$ radical is independently selected from hydrogen, derivatized hydroxyl group, $C_{1-30}$ linear or branched alkyl groups, aryl, aryl-substituted $C_{1-30}$ linear or branched alkyl groups, polyalkoxylated alkyl groups, heteroaromatic organic groups having at least one positive charge without charged nitrogen, at least one quaternized nitrogen atom or at least one amino group having a positive charge in the partial region of the pH range from 2 to 11, or salts thereof, with the proviso that at least one $R^1$, $R^2$, $R^3$, $R^4$ radical is a heteroatomic organic group having at least one positive charge without charged nitrogen, at least one quaternized nitrogen atom or at least one amino group having a positive charge.

Cationic or amphoteric polymers particularly preferred in the context of the present application contain, as a monomer unit, a compound of the general formula

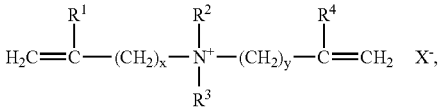

in which $R^1$ and $R^4$ are each independently H or a linear or branched hydrocarbon radical having from 1 to 6 carbon atoms; $R^2$ and $R^3$ are each independently an alkyl, hydroxyalkyl or aminoalkyl group in which the alkyl radical is linear or branched and has between 1 and 6 carbon atoms, which is preferably a methyl group; x and y are each independently integers between 1 and 3. $X^-$ represents a counterion, preferably a counterion from the group of chloride, bromide, iodide, sulfate, hydrogensulfate, methosulfate, lauryl sulfate, dodecylbenzenesulfonate, p-toluenesulfonate (tosylate), cumenesulfonate, xylenesulfonate, phosphate, citrate, formate, acetate or mixtures thereof.

Preferred $R^1$ and $R^4$ radicals in the above formula are selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2CH$(OH)—$CH_3$, —CH(OH)—$CH_2$—$CH_3$, and —$(CH_2CH_2$—$O)_n$H.

Very particular preference is given to polymers which have a cationic monomer unit of the above general formula in which $R^1$ and $R^4$ are each H, $R^2$ and $R^3$ are each methyl and x and y are each 1. The corresponding monomer units of the formula $$H_2C{=}CH{-}(CH_2){-}N^+(CH_3)_2{-}(CH_2){-}CH{=}CH_2X^-$$

are, in the case that $X^-$=chloride, also referred to as DADMAC (diallyldimethylammonium chloride).

Further particularly preferred cationic or amphoteric polymers contain a monomer unit of the general formula $$R^1HC{=}CR^2{-}C(O){-}NH{-}(CH_2)_x{-}N^+R^3R^4R^5X^-$$

in which $R^1$, $R^2$, $R^3$, $R^4$ and $R^5$ are each independently a linear or branched, saturated or unsaturated alkyl or hydroxyalkyl radical having from 1 to 6 carbon atoms, preferably a linear or branched alkyl radical selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2CH$(OH)—$CH_3$, —CH(OH)—$CH_2$—$CH_3$, and —$(CH_2CH_2$—$O)_n$H, and x is an integer between 1 and 6.

Very particular preference is given in the context of the present application to polymers which have a cationic monomer unit of the above general formula in which $R^1$ is H and $R^2$, $R^3$, $R^4$ and $R^5$ are each methyl and x is 3. The corresponding monomer units of the formula $$H_2C{=}C(CH_3){-}C(O){-}NH{-}(CH_2)_x{-}N^+(CH_3)_3X^-$$

are, in the case that $X^{31}$ =chloride, also referred to as MAPTAC (methacrylamidopropyltrimethylammonium chloride).

Preference is given in accordance with the invention to using polymers which contain, as monomer units, diallyldimethylammonium salts and/or acrylamidopropyltrimethylammonium salts.

The aforementioned amphoteric polymers have not only cationic groups but also anionic groups or monomer units. Such anionic monomer units stem, for example, from the group of the linear or branched, saturated or unsaturated carboxylates, the linear or branched, saturated or unsaturated phosphonates, the linear or branched, saturated or unsaturated sulfates or the linear or branched, saturated or unsaturated sulfonates. Preferred monomer units are acrylic acid, (meth)acrylic acid, (dimethyl)acrylic acid, (ethyl)acrylic acid, cyanoacrylic acid, vinylacetic acid, allylacetic acid, crotonic acid, maleic acid, fumaric acid, cinnamic acid and derivatives thereof, the allylsulfonic acids, for example, alkyloxybenzenesulfonic acid and methallylsulfonic acid, or the allylphosphonic acids.

Preferred usable amphoteric polymers stem from the group of the alkylacrylamide/acrylic acid copolymers, the alkylacrylamide/methacrylic acid copolymers, the alkylacrylamide/methylmethacrylic acid copolymers, the alkylacrylamide/acrylic acid/alkylaminoalkyl (meth)acrylic acid copolymers, the alkylacrylamide/methacrylic acid/alkylaminoalkyl (meth)acrylic acid copolymers, the alkylacrylamide/methylmethacrylic acid/alkylaminoalkyl (meth)acrylic acid copolymers, the alkylacrylamide/alkyl methacrylate/alkylaminoethyl methacrylate/alkyl methacrylate copolymers, and the copolymers formed from unsaturated carboxylic acids, cationically derivatized unsaturated carboxylic acids and optionally further ionic or nonionic monomers.

Zwitterionic polymers usable with preference stem from the group of the acrylamidoalkyltrialkylammonium chloride/acrylic acid copolymers and their alkali metal and ammonium salts, the acrylamidoalkyltrialkylammonium chloride/methacrylic acid copolymers and their alkali metal and ammonium salts, and the methacryloylethylbetaine/methacrylate copolymers.

Preference is further given to amphoteric polymers which, in addition to one or more anionic monomers, comprise, as cationic monomers, methacrylamidoalkyltrialkylammonium chloride and dimethyl(diallyl)-ammonium chloride.

Particularly preferred amphoteric polymers stem from the group of the methacrylamidoalkyltrialkylammonium chloride/dimethyl(diallyl)ammonium chloride/acrylic acid copolymers, the methacrylamidoalkyltrialkylammonium chloride/dimethyl(diallyl)ammonium chloride/methacrylic acid copolymers and the methacrylamidoalkyltrialkylammonium chloride/dimethyl(diallyl)ammonium chloride/alkyl(meth)acrylic acid copolymers and their alkali metal and ammonium salts.

Especially preferred are amphoteric polymers from the group of the methacrylamidopropyltrimethylammonium chloride/dimethyl(diallyl)ammonium chloride/acrylic acid copolymers, the methacrylamidopropyltrimethylammonium chloride/dimethyl(diallyl)ammonium chloride/acrylic acid copolymers and the methacrylamidopropyltrimethylammonium chloride/dimethyl(diallyl)ammonium chloride/alkyl(meth)acrylic acid copolymers and their alkali metal and ammonium salts.

In a particularly preferred embodiment of the present invention, the polymers are present in prefinished form. Suitable means of finishing the polymers include the encapsulation of the polymers by means of water-soluble or water-dispersible coating compositions, preferably by means of water-soluble or water-dispersible natural or synthetic polymers;

the encapsulation of the polymers by means of water-insoluble, meltable coating compositions, preferably by means of water-insoluble coating compositions from the groups of the waxes or paraffins having a melting point above 30° C.; and the cogranulation of the polymers with inert support materials, preferably with support materials from the group of the washing- or cleaning-active substances, more preferably from the group of the builders or cobuilders.

Washing or cleaning compositions comprise the aforementioned cationic and/or amphoteric polymers preferably in amounts of between 0.01 and 10% by weight, based in each case on the total weight of the washing or cleaning composition. However, preference is given in the context of the present application to those washing or cleaning compositions in which the proportion by weight of the cationic and/or amphoteric polymers is between 0.01 and 8% by weight, preferably between 0.01 and 6% by weight, preferentially between 0.01 and 4% by weight, more preferably between 0.01 and 2% by weight and, in particular, between 0.01 and 1% by weight, based in each case on the total weight of the machine dishwasher detergent.

Polymers effective as softeners are, for example, the polymers containing sulfonic acid groups, which are used with particular preference.

Polymers which contain sulfonic acid groups and can be used with particular preference are copolymers of unsaturated carboxylic acids, monomers containing sulfonic acid groups and optionally further ionic or nonionic monomers.

In the context of the present invention, preference is given, as a monomer, to unsaturated carboxylic acids of the formula $$R^1(R^2)C{=}C(R^3)COOH$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals substituted by —$NH_2$, —OH or —COOH, or are —COOH or —$COOR^4$ where $R^4$ is a saturated or unsaturated, straight-chain or branched hydrocarbon radical having from 1 to 12 carbon atoms.

Among the unsaturated carboxylic acids which can be described by the formula above, preference is given, in particular, to acrylic acid (R1=R2=R3=H), methacrylic acid (R1=R2=H; R3=CH3) and/or maleic acid (R1=COOH; R2=R3=H).

The monomers containing sulfonic acid groups are preferably those of the formula $$R^5(R^6)C{=}C(R^7)—X—SO_3H$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Among these monomers, preference is given to those of the formulas $H_2C{=}CH{-}X{-}SO_3H$ $H_2C{=}C(CH_3){-}X{-}SO_3H$ $HO_3S{-}X{-}(R^6)C{=}C(R^7){-}SO_3H$ in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —$(CH_2)_n$— where n=from 0 to 4, —COO—$(CH_2)_k$— where k=from 1 to 6, —C(O)—NH—C $(CH_3)_2$— and —C(O)—NH—$CH(CH_2CH_3)$—.

Particularly preferred monomers containing sulfonic acid groups are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, sulfomethylmethacrylamide and water-soluble salts of the acids mentioned.

Useful further ionic or nonionic monomers are, in particular, ethylenically unsaturated compounds. The content of these further ionic or nonionic monomers in the polymers used is preferably less than 20% by weight, based on the polymer. Polymers to be used with particular preference consist only of monomers of the formula $R^1(R^2)C{=}C(R^3)COOH$ and of monomers of the formula $R^5(R^6)C{=}C(R^7){-}X{-}SO_3H$.

In summary, particular preference is given to copolymers of i) unsaturated carboxylic acids of the formula $R^1(R^2)C{=}C(R^3)COOH$ in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, ii) sulfonic acid-containing monomers of the formula $R^5(R^6)C{=}C(R^7){-}X{-}SO_3H$ in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—C $(CH_3)_2$— and —C(O)—NH—$CH(CH_2CH_3)$—, iii) optionally further ionic or nonionic monomers.

Further particularly preferred copolymers consist of i) one or more unsaturated carboxylic acids from the group of acrylic acid, methacrylic acid and/or maleic acid, ii) one or more monomers containing sulfonic acid groups of the formulas:

$H_2C{=}CH{-}X{-}SO_3H$ $H_2C{=}C(CH_3){-}X{-}SO_3H$ $HO_3S{-}X{-}(R^6)C{=}C(R^7){-}X{-}SO_3H$ in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$— iii) optionally further ionic or nonionic monomers.

The copolymers may contain the monomers from groups i) and ii) and optionally iii) in varying amounts, and it is possible to combine any of the representatives from group i) with any of the representatives from group ii) and any of the representatives from group iii). Particularly preferred polymers have certain structural units which are described below.

Thus, preference is given, for example, to copolymers which contain structural units of the formula $$-[CH_2{-}CHCOOH]_m{-}[CH_2{-}CHC(O){-}Y{-}SO_3H]_p{-}$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

These polymers are prepared by copolymerization of acrylic acid with an acrylic acid derivative containing sulfonic acid groups. Copolymerizing the acrylic acid derivative containing sulfonic acid groups with methacrylic acid leads to another polymer, the use of which is likewise preferred. The corresponding copolymers contain structural units of the formula $$-[CH_2{-}C(CH_3)COOH]_m{-}[CH_2{-}CHC(O){-}Y{-}SO_3H]_p{-}$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

Acrylic acid and/or methacrylic acid can also be copolymerized entirely analogously with methacrylic acid derivatives containing sulfonic acid groups, which changes the structural units within the molecule. Thus, copolymers which contain structural units of the formula $$-[CH_2{-}CHCOOH]_m{-}[CH_2{-}C(CH_3)C(O){-}Y{-}SO_3H]_p{-}$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, where spacer groups in which Y is —O—$(CH_2)_n$— where n=from 0 to 4, is —O—$(C_6H_4)$—, is —NH—$C(CH_3)_2$— or —NH—$CH(CH_2CH_3)$— are just as preferred as copolymers which contain structural units of the formula $$—[CH_2—C(CH_3)COOH]_m—[CH_2—C(CH_3)C(O)—Y—SO_3H]_p—$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

Instead of acrylic acid and/or methacrylic acid, or in addition thereto, it is also possible to use maleic acid as a particularly preferred monomer from group i). This leads to copolymers which are preferred in accordance with the invention and contain structural units of the formula $$—[HOOCCH—CHCOOH]_m—[CH_2—CHC(O)—Y—SO_3H]_p—$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—. Preference is further given in accordance with the invention to copolymers which contain structural units of the formula $$—[HOOCCH—CHCOOH]_m—[CH_2—C(CH_3)C(O)O—Y—SO_3H]_p—$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

In summary, preference is given according to the invention to those copolymers which contain structural units of the formulas $$—[CH_2—CHCOOH]_m—[CH_2—CHC(O)—Y—SO_3H]_p—$$

$$—[CH_2—C(CH_3)COOH]_m—[CH_2—CHC(O)—Y—SO_3H]_p—$$

$$—[CH_2—CHCOOH]_m—[CH_2—C(CH_3)C(O)—Y—SO_3H]_p—$$

$$—[CH_2—C(CH_3)COOH]_m—[CH_2—C(CH_3)C(O)—Y—SO_3H]_p—$$

$$—[HOOCCH—CHCOOH]_m—[CH_2—CHC(O)—Y—SO_3H]_p—$$

$$—[HOOCCH—CHCOOH]_m—[CH_2—C(CH_3)C(O)O—Y—SO_3H]_p—$$

in which m and p are each a whole natural number between 1 and 2,000, and Y is a spacer group which is selected from substituted or unsubstituted, aliphatic, aromatic or substituted aromatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

In the polymers, all or some of the sulfonic acid groups may be in neutralized form, i.e., the acidic hydrogen atom of the sulfonic acid group may be replaced in some or all of the sulfonic acid groups by metal ions, preferably alkali metal ions and, in particular, by sodium ions. The use of copolymers containing partially or completely neutralized sulfonic acid groups is preferred in accordance with the invention.

The monomer distribution of the copolymers used with preference in accordance with the invention is, in the case of copolymers which contain only monomers from groups i) and ii), preferably in each case from 5 to 95% by weight of i) or ii), more preferably from 50 to 90% by weight of monomer from group i) and from 10 to 50% by weight of monomer from group ii), based in each case on the polymer.

In the case of terpolymers, particular preference is given to those which contain from 20 to 85% by weight of monomer from group i), from 10 to 60% by weight of monomer from group ii), and from 5 to 30% by weight of monomer from group iii).

The molar mass of the sulfo copolymers used with preference in accordance with the invention can be varied in order to adapt the properties of the polymers to the desired end use. Preferred washing or cleaning compositions are characterized in that the copolymers have molar masses of from 2,000 to 200,000 $gmol^{-1}$, preferably from 4,000 to 25,000 $gmol^{-1}$ and, in particular, from 5,000 to 15,000 $gmol^{-1}$.

Bleaches.

The bleaches are a washing- or cleaning-active substance used with particular preference. Among the compounds which serve as bleaches and supply $H_2O_2$ in water, sodium percarbonate, sodium perborate tetrahydrate and sodium perborate monohydrate are of particular significance. Further bleaches which can be used are, for example, peroxypyrophosphates, citrate perhydrates, and $H_2O_2$-supplying peracidic salts or peracids, such as perbenzoates, peroxophthalates, diperazelaic acid, phthaloimino peracid or diperdodecanedioic acid.

It is also possible to use bleaches from the group of the organic bleaches. Typical organic bleaches are the diacyl peroxides, for example, dibenzoyl peroxide. Further typical organic bleaches are the peroxy acids, particular examples being the alkyl peroxy acids and the aryl peroxy acids. Preferred representatives are (a) the peroxybenzoic acid and ring-substituted derivatives thereof, such as alkylperoxybenzoic acids, but it is also possible to use peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid [phthaloiminoperoxy-hexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid and N,N-terephthaloyldi(6-aminopercaproic acid).

The bleaches used may also be substances which release chlorine or bromine. Among suitable chlorine- or bromine-releasing materials, useful examples include heterocyclic N-bromoamides and N-chloroamides, for example, trichloroisocyanuric acid, tribromoisocyanuric acid, dibromoisocyanuric acid and/or dichloroisocyanuric acid (DICA) and/or salts thereof with cations such as potassium and sodium.

Hydantoin compounds, such as 1,3-dichloro-5,5-dimethylhydantoin, are likewise suitable.

According to the invention, preference is given to washing or cleaning compositions, especially machine dishwasher detergents, which contain from 1 to 35% by weight, preferably from 2.5 to 30% by weight, more preferably from 3.5 to 20% by weight and, in particular, from 5 to 15% by weight of bleach, preferably sodium percarbonate.

The active oxygen context of the washing or cleaning compositions, especially machine dishwasher detergents, is, based in each case on the total weight of the composition, preferably between 0.4 and 10% by weight, more preferably between 0.5 and 8% by weight and, in particular, between 0.6 and 5% by weight. Particularly preferred compositions have an active oxygen content above 0.3% by weight, preferably above 0.7% by weight, more preferably above 0.8% by weight and, in particular, above 1.0% by weight.

Bleach Activators.

Bleach activators are used, for example, in washing or cleaning compositions, in order to achieve improved bleaching action when cleaning at temperatures of 60° C. and below. Bleach activators which may be used are compounds which, under perhydrolysis conditions, give rise to aliphatic peroxocarboxylic acids having preferably from 1 to 10 carbon atoms, in particular, from 2 to 4 carbon atoms, and/or optionally substituted perbenzoic acid. Suitable substances bear O-acyl and/or N-acyl groups of the number of carbon atoms specified, and/or optionally substituted benzoyl groups. Preference is given to polyacylated alkylenediamines, in particular, tetraacetylethylenediamine (TAED), acylated triazine derivatives, in particular, 1,5-diacetyl-2,4-dioxohexahydro-1,3,5-triazine (DADHT), acylated glycolurils, in particular, tetraacetylglycoluril (TAGU), N-acylimides, in particular, N-nonanoylsuccinimide (NOSI), acylated phenolsulfonates, in particular, n-nonanoyl- or isononanoyloxybenzenesulfonate (n- or iso-NOBS), carboxylic anhydrides, in particular, phthalic anhydride, acylated polyhydric alcohols, in particular, triacetin, ethylene glycol diacetate and 2,5-diacetoxy-2,5-dihydrofuran.

Further bleach activators used with preference in the context of the present application are compounds from the group of the cationic nitriles, especially cationic nitriles of the formula

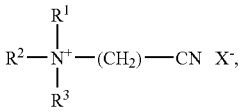

in which $R^1$ is —H, —$CH_3$, a $C_{2-24}$-alkyl or -alkenyl radical, a substituted $C_{2-24}$-alkyl or -alkenyl radical having at least one substituent from the group of —Cl, —Br, —OH, —$NH_2$, —CN, an alkyl- or alkenylaryl radical having a $C_{1-24}$-alkyl group, or is a substituted alkyl- or alkenylaryl radical having a $C_{1-24}$-alkyl group and at least one further substituent on the aromatic ring, $R^2$ and $R^3$ are each independently selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2$—$CH_2$—O)$_n$H where n=1, 2, 3, 4, 5 or 6, and X is an anion.

Particular preference is given to a cationic nitrile of the formula

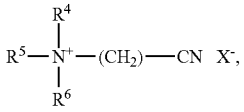

in which $R^4$, $R^5$ and $R^6$ are each independently selected from —$CH_3$, —$CH_2$—$CH_3$, —$CH_2$—$CH_2$—$CH_3$, —CH($CH_3$)—$CH_3$, where $R^4$ may additionally also be —H, and X is an anion, it being preferred that $R^5$=$R^6$=—$CH_3$ and, in particular, $R^4$=$R^5$=$R^6$=—$CH_3$, and particular preference being given to compounds of the formulas $(CH_3)_3N^{(+)}CH_2$—CN $X^-$, $(CH_3CH_2)_3N^{(+)}CH_2$—CN $X^-$, $(CH_3CH_2CH_2)_3N^{(+)}CH_2$—CN $X^-$, $(CH_3CH(CH_3))_3N^{(+)}CH_2$—CN $X^-$ or (HO—$CH_2$—$CH_2$)$_3N^{(+)}CH_2$—CN $X^-$, particular preference being given in turn, from this group of substances, to the cationic nitrile of the formula $(CH_3)_3N^{(+)}CH_2$—CN $X^-$ in which $X^-$ is an anion which is selected from the group of chloride, bromide, iodide, hydrogensulfate, methosulfate, p-toluenesulfonate (tosylate) or xylenesulfonate.

The bleach activators used may also be compounds which, under perhydrolysis conditions, give rise to aliphatic peroxocarboxylic acids having preferably from 1 to 10 carbon atoms, in particular, from 2 to 4 carbon atoms, and/or optionally substituted perbenzoic acid. Suitable substances bear O-acyl and/or N-acyl groups of the number of carbon atoms specified, and/or optionally substituted benzoyl groups. Preference is given to polyacylated alkylenediamines, in particular, tetraacetylethylenediamine (TAED), acylated triazine derivatives, in particular, 1,5-diacetyl-2,4-dioxohexahydro-1,3,5-triazine (DADHT), acylated glycolurils, in particular, tetraacetylglycoluril (TAGU), N-acylimides, in particular, N-nonanoylsuccinimide (NOSI), acylated phenolsulfonates, in particular, n-nonanoyl- or isononanoyloxybenzenesulfonate (n- or iso-NOBS), carboxylic anhydrides, in particular, phthalic anhydride, acylated polyhydric alcohols, in particular, triacetin, ethylene glycol diacetate, 2,5-diacetoxy-2,5-dihydrofuran, n-methylmorpholiniumacetonitrile methylsulfate (MMA), and also acetylated sorbitol and mannitol or mixtures thereof (SORMAN), acylated sugar derivatives, in particular, pentaacetylglucose (PAG), pentaacetylfructose, tetraacetyl-xylose and octaacetyllactose, and acetylated, optionally N-alkylated, glucamine and gluconolactone, and/or N-acylated lactams, for example, N-benzoylcaprolactam. Hydrophilically substituted acylacetals and acyllactams are likewise used with preference. Combinations of conventional bleach activators can also be used.

When further bleach activators are to be used in addition to the nitrile quats, preference is given to using bleach activators from the group of the polyacylated alkylene-diamines, in particular, tetraacetylethylenediamine (TAED), N-acylimides, in particular, N-nonanoylsuccinimide (NOSI), acylated phenolsulfonates, in particular, n-nonanoyl- or isononanoyloxybenzenesulfonate (n- or iso-NOBS), n-methylmorpholiniumacetonitrile methylsulfate (MMA), preferably in amounts up to 10% by weight, in particular from 0.1% by weight to 8% by weight, particularly from 2 to 8% by weight and more preferably from 2 to 6% by weight, based in each case on the total weight of the composition containing bleach activator.

In addition to the conventional bleach activators, or instead of them, it is also possible to use so-called bleach catalysts. These substances are bleach-boosting transition metal salts or transition metal complexes, for example, salen or carbonyl complexes of Mn, Fe, Co, Ru or Mo. It is also possible to use complexes of Mn, Fe, Co, Ru, Mo, Ti, V and Cu with N-containing tripod ligands, and also Co—, Fe—, Cu— and Ru-ammine complexes as bleach catalysts.

Bleach-boosting transition metal complexes, in particular with the central atoms Mn, Fe, Co, Cu, Mo, V, Ti and/or Ru, preferably selected from the group of manganese and/or cobalt salts and/or complexes, more preferably the cobalt (ammine) complexes, the cobalt (acetate) complexes, the cobalt (carbonyl) complexes, the chlorides of cobalt or manganese, and manganese sulfate, are used in customary amounts, preferably in an amount up to 5% by weight, in particular from 0.0025% by weight to 1% by weight and more preferably from 0.01% by weight to 0.25% by weight, based in each case on the total weight of the composition containing bleach activator. In specific cases, though, it is also possible to use a greater amount of bleach activator.

Enzymes.

To increase the washing or cleaning performance of washing or cleaning compositions, it is possible to use enzymes. These include in particular proteases, amylases, lipases, hemicellulases, cellulases or oxidoreductases, and preferably mixtures thereof. These enzymes are in principle of natural origin; starting from the natural molecules, improved variants are available for use in washing and cleaning compositions and are preferably used accordingly. Washing or cleaning compositions preferably contain enzymes in total amounts of from $1\times10^{-6}$ to 5% by weight based on active protein. The protein concentration may be determined with the aid of known methods, for example, the BCA method or the biuret method.

Among the proteases, preference is given to those of the subtilisin type. Examples thereof include the subtilisins BPN' and Carlsberg, protease PB92, the subtilisins 147 and 309, *Bacillus lentus* alkaline protease, subtilisin DY and the enzymes thermitase and proteinase K which can be classified to the subtilases but no longer to the subtilisins in the narrower sense, and the proteases TW3 and TW7. The subtilisin Carlsberg is available in a developed form under the trade name Alcalase® from Novozymes A/S, Bagsvaerd, Denmark. The subtilisins 147 and 309 are sold under the trade names Esperase® and Savinase® respectively by Novozymes. The variants listed under the name BLAP® are derived from the protease of *Bacillus lentus* DSM 5483.

Further examples of useful proteases are the enzymes available under the trade names Durazym®, Relase®, Everlase®, Nafizym, Natalase®, Kannase® and Ovozymes® from Novozymes, those under the trade names Purafect®, Purafect®OxP and Properase® from Genencor, that under the trade name Protosol® from Advanced Biochemicals Ltd., Thane, India, that under the trade name Wuxi® from Wuxi Snyder Bioproducts Ltd., China, those under the trade names Proleather® and Protease P® from Amano Pharmaceuticals Ltd., Nagoya, Japan and that under the name Proteinase K-16 from Kao Corp., Tokyo, Japan.

Examples of amylases which can be used in accordance with the invention are the α-amylases from *Bacillus licheniformis*, from *B. amyloliquefaciens* or from *B. stearothermophilus* and developments thereof which have been improved for use in washing and cleaning compositions. The *B. licheniformis* enzyme is available from Novozymes under the name Termamyl® and from Genencor under the name Purastar®ST. Development products of this α-amylase are obtainable from Novozymes under the trade names Duramyl® and Termamyl®ultra, from Genencor under the name Purastar®OxAm and from Daiwa Seiko Inc., Tokyo, Japan as Keistase®. The *B. amyloliquefaciens* α-amylase is sold by Novozymes under the name BAN®, and variants derived from the *B. stearothermophilus* α-amylase under the names BSG® and Novamyl®, likewise from Novozymes.

Enzymes which should additionally be emphasized for this purpose are the α-amylase from *Bacillus* sp. A 7-7 (DSM 12368), and the cyclodextrin glucanotransferase (CGTase) from *B. agaradherens* (DSM 9948).

Also suitable are the developments of α-amylase from *Aspergillus niger* and *A. oryzae*, which are available under the trade names Fungamyl® from Novozymes. Another commercial product is Amylase-LT®, for example.

Furthermore, lipases or cutinases may be used according to the invention, especially owing to their triglyceride-cleaving activities, but also in order to generate peracids in situ from suitable precursors. Examples thereof include the lipases which were originally obtainable from *Humicola lanuginosa* (*Thermomyces lanuginosus*) or have been developed, in particular those with the D96L amino acid substitution. They are sold, for example, under the trade names Lipolase®, Lipolase®Ultra, LipoPrime®, Lipozyme® and Lipex® by Novozymes. It is additionally possible, for example, to use the cutinases which have originally been isolated from *Fusarium* solani pisi and *Humicola* insolens. Lipases which are also useful can be obtained under the designations Lipase CE®, Lipase P®, Lipase B®, Lipase CES®, Lipase AKG®, *Bacillis* sp. Lipase®, Lipase AP®, Lipase M-AP® and Lipase AML® from Amano. Examples of lipases and cutinases from Genencor which can be used are those whose starting enzymes have originally been isolated from *Pseudomonas mendocina* and *Fusarium solanii*. Other important commercial products include the M1 Lipase® and Lipomax® preparations originally sold by Gist-Brocades and the enzymes sold under the names Lipase MY-30®, Lipase OF® and Lipase PL® by Meito Sangyo KK, Japan, and also the product Lumafast® from Genencor.

It is also possible to use enzymes which are combined under the term hemicellulases. These include, for example, mannanases, xanthane lyases, pectin lyases (=pectinases), pectin esterases, pectate lyases, xyloglucanases (=xylanases), pullulanases and β-glucanases. Suitable mannanases are available, for example, under the names Gamanase® and Pektinex AR® from Novozymes, under the name Rohapec® B1L from AB Enzymes and under the name Pyrolase® from Diversa Corp., San Diego, Calif., USA. The β-glucanase obtained from *B. subtilis* is available under the name Cereflo® from Novozymes.

To enhance the bleaching action, it is possible in accordance with the invention to use oxidoreductases, for example, oxidases, oxygenases, catalases, peroxidases, such as haloperoxidases, chloroperoxidases, bromoperoxidases, lignin peroxidases, glucose peroxidases or manganese peroxidases, dioxygenases or laccases (phenol oxidases, polyphenol oxidases). Suitable commercial products include Denilite® 1 and 2 from Novozymes. Advantageously, preferably organic, more preferably aromatic, compounds which interact with the enzymes are additionally added in order to enhance the activity of the oxidoreductases concerned (enhancers), or to ensure the electron flux in the event of large differences in the redox potentials of the oxidizing enzymes and the soilings (mediators).

The enzymes derive, for example, either originally from microorganisms, for example, of the genera *Bacillus, Streptomyces, Humicola*, or *Pseudomonas*, and/or are produced in biotechnology processes known per se by suitable microorganisms, for instance by transgenic expression hosts of the genera *Bacillus* or filamentous fungi.

The enzymes in question are preferably purified via processes which are established per se, for example, via precipitation, sedimentation, concentration, filtration of the liquid phases, microfiltration, ultrafiltration, the action of chemicals, deodorization or suitable combinations of these steps.

The enzymes may be used in any form established in the prior art. These include, for example, the solid preparations obtained by granulation, extrusion or lyophilization, or, especially in the case of liquid or gel-form compositions, solutions of the enzymes, advantageously highly concentrated, low in water and/or admixed with stabilizers.

Alternatively, the enzymes may be encapsulated either for the solid or for the liquid administration form, for example, by spray-drying or extrusion of the enzyme solution together with a preferably natural polymer, or in the form of capsules, for example, those in which the enzymes are enclosed as in a solidified gel, or in those of the core-shell type, in which an enzyme-containing core is coated with a water-, air- and/or chemical-impermeable protective layer. It is possible in layers applied thereto to additionally apply further active ingredients, for example, stabilizers, emulsifiers, pigments, bleaches or dyes. Such capsules are applied by methods known per se, for example, by agitated or roll granulation or in fluidized bed processes. Advantageously, such granules, for example, as a result of application of polymeric film formers, are low-dusting and storage-stable owing to the coating.

It is also possible to formulate two or more enzymes together, so that a single granule has a plurality of enzyme activities.

A protein and/or enzyme may be protected, particularly during storage, from damage, for example, inactivation, denaturation or decay, for instance by physical influences, oxidation or proteolytic cleavage. When the proteins and/or enzymes are obtained microbially, particular preference is given to inhibiting proteolysis, especially when the compositions also comprise proteases. For this purpose, washing or cleaning compositions may comprise stabilizers; the provision of such compositions constitutes a preferred embodiment of the present invention.

One group of stabilizers is that of reversible protease inhibitors. Frequently, benzamidine hydrochloride, borax, boric acids, boronic acids or salts or esters thereof are used, and of these in particular derivatives having aromatic groups, for example, ortho-substituted, meta-substituted and para-substituted phenylboronic acids, or the salts or esters thereof. Peptidic protease inhibitors which should be mentioned include ovomucoid and leupeptin; an additional option is the formation of fusion proteins of proteases and peptide inhibitors.

Further enzyme stabilizers are amino alcohols such as mono-, di-, triethanol- and -propanolamine and mixtures thereof, aliphatic carboxylic acids up to $C_{12}$, such as succinic acid, other dicarboxylic acids or salts of the acids mentioned. Terminally capped fatty acid amide alkoxylates are also suitable. Certain organic acids used as builders are additionally capable of stabilizing an enzyme present.

Lower aliphatic alcohols, but in particular polyols, for example, glycerol, ethylene glycol, propylene glycol or sorbitol, are other frequently used enzyme stabilizers. Calcium salts are likewise used, for example, calcium acetate or calcium formate, as are magnesium salts.

Polyamide oligomers or polymeric compounds such as lignin, water-soluble vinyl copolymers or cellulose ethers, acrylic polymers and/or polyamides stabilize the enzyme preparation against influences including physical influences or pH fluctuations. Polyamine N-oxide-containing polymers act as enzyme stabilizers. Other polymeric stabilizers are the linear $C_8$-$C_{18}$ polyoxyalkylenes. Alkylpolyglycosides can stabilize the enzymatic components and even increase their performance. Crosslinked N-containing compounds likewise act as enzyme stabilizers.

Reducing agents and antioxidants increase the stability of the enzymes against oxidative decay. An example of a sulfur-containing reducing agent is sodium sulfite.

Preference is given to using combinations of stabilizers, for example, of polyols, boric acid and/or borax, the combination of boric acid or borate, reducing salts and succinic acid or other dicarboxylic acids or the combination of boric acid or borate with polyols or polyamino compounds and with reducing salts. The action of peptide-aldehyde stabilizers is increased by the combination with boric acid and/or boric acid derivatives and polyols, and further enhanced by the additional use of divalent cations, for example, calcium ions.

Preference is given to using one or more enzymes and/or enzyme preparations, preferably solid protease preparations and/or amylase preparations, in amounts of from 0.1 to 5% by weight, preferably of from 0.2 to 4.5% by weight and in particular from 0.4 to 4% by weight, based in each case on the overall composition containing enzyme.

Glass Corrosion Inhibitors.

Glass corrosion inhibitors prevent the occurrence of cloudiness, smears and scratches, but also the iridescence of the glass surface of machine-cleaned glasses. Preferred glass corrosion inhibitors stem from the group of the magnesium and/or zinc salts and/or magnesium and/or zinc complexes.

A preferred class of compounds which can be used to prevent glass corrosion is that of insoluble zinc salts.

In the context of this preferred embodiment, insoluble zinc salts are zinc salts which have a maximum solubility of 10 grams of zinc salt per liter of water at 20° C. Examples of insoluble zinc salts which are particularly preferred in accordance with the invention are zinc silicate, zinc carbonate, zinc oxide, basic zinc carbonate ($Zn_2(OH)_2CO_3$), zinc hydroxide, zinc oxalate, zinc monophosphate ($Zn_3(PO_4)_2$) and zinc pyrophosphate ($Zn_2(P_2O_7)$).

The zinc compounds mentioned are preferably used in amounts which bring about a content of zinc ions in the compositions of between 0.02 and 10% by weight, preferably between 0.1 and 5.0% by weight and in particular between 0.2 and 1.0% by weight, based in each case on the overall composition containing glass corrosion inhibitor. The exact content in the compositions of the zinc salt or the zinc salts is by its nature dependent on the type of the zinc salts—the less soluble the zinc salt used, the higher its concentration in the compositions.

Since the insoluble zinc salts remain for the most part unchanged during the dishwashing operation, the particle size of the salts is a criterion to be considered, so that the salts do not adhere to glassware or parts of the machine. Preference is given here to compositions in which the insoluble zinc salts have a particle size below 1.7 millimeters.

When the maximum particle size of the insoluble zinc salts is less than 1.7 mm, there is no risk of insoluble residues in the dishwasher. The insoluble zinc salt preferably has an average particle size which is distinctly below this value in order to further minimize the risk of insoluble residues, for example, an average particle size of less than 250 μm. The lower the solubility of the zinc salt, the more important this is. In addition, the glass corrosion-inhibiting effectiveness increases with decreasing particle size. In the case of very sparingly soluble zinc salts, the average particle size is preferably below 100 μm. For even more sparingly soluble salts, it may be lower still; for example, average particle sizes below 60 μm are preferred for the very sparingly soluble zinc oxide.

A further preferred class of compounds is that of magnesium and/or zinc salt(s) of at least one monomeric and/or polymeric organic acid. These have the effect that, even upon repeated use, the surfaces of glassware are not altered as a result of corrosion, and in particular no cloudiness, smears or scratches, and also no iridescence of the glass surfaces, are caused.

Even though all magnesium and/or zinc salt(s) of monomeric and/or polymeric organic acids may be used, preference is given to the magnesium and/or zinc salts of monomeric and/or polymeric organic acids from the groups of the unbranched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxo acids, the amino acids and/or the polymeric carboxylic acids.

The spectrum of the zinc salts, preferred in accordance with the invention, of organic acids, preferably of organic carboxylic acids, ranges from salts which are sparingly soluble or insoluble in water, i.e., have a solubility below 100 mg/l, preferably below 10 mg/l, in particular below 0.01 mg/l, to those salts which have a solubility in water above 100 mg/l, preferably above 500 mg/l, more preferably above 1 g/l and in particular above 5 g/l (all solubilities at water temperature 20° C.). The first group of zinc salts includes, for example, zinc citrate, zinc oleate and zinc stearate; the group of soluble zinc salts includes, for example, zinc formate, zinc acetate, zinc lactate and zinc gluconate.

With particular preference, the glass corrosion inhibitor used is at least one zinc salt of an organic carboxylic acid, more preferably a zinc salt from the group of zinc stearate, zinc oleate, zinc gluconate, zinc acetate, zinc lactate and/or zinc citrate. Preference is also given to zinc ricinoleate, zinc abietate and zinc oxalate.

In the context of the present invention, the content of zinc salt in cleaning compositions is preferably between 0.1 and 5% by weight, preferably between 0.2 and 4% by weight and in particular between 0.4 and 3% by weight, or the content of zinc in oxidized form (calculated as $Zn^{2+}$) is between 0.01 and 1% by weight, preferably between 0.02 and 0.5% by weight and in particular between 0.04 and 0.2% by weight, based in each case on the total weight of the composition containing glass corrosion inhibitor.

Corrosion Inhibitors.

Corrosion inhibitors serve to protect the ware or the machine, particularly silver protectants having particular significance in the field of machine dishwashing. It is possible to use the known substances from the prior art. In general, it is possible in particular to use silver protectants selected from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. Examples of the 3-amino-5-alkyl-1,2,4-triazoles to be used with preference in accordance with the invention include: propyl-, -butyl-, -pentyl-, -heptyl-, -octyl-, -nonyl-, -decyl-, -undecyl-, -dodecyl-, -isononyl-, -Versatic-10 acid alkyl-, -phenyl-, -p-tolyl-, -(4-tert-butylphenyl)-, -(4-methoxyphenyl)-, -(2-, -3-, -4-pyridyl)-, -(2-thienyl)-, -(5-methyl-2-furyl)-, -(5-oxo-2-pyrrolidinyl)-3-amino-1,2,4-triazole. In machine dishwasher detergents, the alkylamino-1,2,4-triazoles or their physiologically compatible salts are used in a concentration of from 0.001 to 10% by weight, preferably from 0.0025 to 2% by weight, more preferably from 0.01 to 0.04% by weight. Preferred acids for the salt formation are hydrochloric acid, sulfuric acid, phosphoric acid, carbonic acid, sulfurous acid, organic carboxylic acids such as acetic acid, glycolic acid, citric acid, succinic acid. Very particularly effective are 5-pentyl-, 5-heptyl-, 5-nonyl-, 5-undecyl-, 5-isononyl-, 5-Versatic-10 acid alkyl-3-amino-1,2,4-triazoles, and also mixtures of these substances.

Frequently also found in cleaning formulations are active chlorine-containing agents which can significantly reduce the corrosion of the silver surface. In chlorine-free cleaners, particularly oxygen- and nitrogen-containing organic redox-active compounds are used, such as di- and trihydric phenols, for example, hydroquinone, pyrocatechol, hydroxyhydroquinone, gallic acid, phloroglucinol, pyrogallol and derivatives of these classes of compound. Salt- and complex-type inorganic compounds, such as salts of the metals Mn, Ti, Zr, Hf, V, Co and Ce, also frequently find use. Preference is given in this context to the transition metal salts which are selected from the group of manganese and/or cobalt salts and/or complexes, more preferably cobalt (ammine) complexes, cobalt (acetate) complexes, cobalt (carbonyl) complexes, the chlorides of cobalt or manganese, and manganese sulfate. Zinc compounds may likewise be used to prevent corrosion on the ware.

Instead of or in addition to the above-described silver protectants, for example, the benzotriazoles, it is possible to use redox-active substances. These substances are preferably inorganic redox-active substances from the group of the manganese, titanium, zirconium, hafnium, vanadium, cobalt and cerium salts and/or complexes, the metals preferably being in one of the oxidation states II, III , IV, V or VI.

The metal salts or metal complexes used should be at least partially soluble in water. The counterions suitable for the salt formation include all customary singly, doubly or triply negatively charged inorganic anions, for example, oxide, sulfate, nitrate, fluoride, but also organic anions, for example, stearate.

Metal complexes in the context of the invention are compounds which consist of a central atom and one or more ligands, and optionally additionally one or more of the above-mentioned anions. The central atom is one of the above-mentioned metals in one of the above-mentioned oxidation states. The ligands are neutral molecules or anions which are mono- or polydentate; the term "ligands" in the context of the invention is explained in more detail, for example, in "Römpp Chemie Lexikon, Georg Thieme Verlag, Stuttgart/New York, 9th edition, 1990, page 2507." When the charge of the central atom and the charge of the ligand(s) within a metal complex do not add up to zero, depending on whether there is a cationic or an anionic charge excess, either one or more of the above-mentioned anions or one or more cations, for example, sodium, potassium, ammonium ions, ensure that the charge balances. Suitable complexing agents are, for example, citrate, acetyl acetonate or 1-hydroxyethane-1,1-diphosphonate.

The definition of "oxidation state" customary in chemistry is reproduced, for example, in "Römpp Chemie Lexikon, Georg Thieme Verlag, Stuttgart/New York, 9th edition, 1991, page 3168."

Particularly preferred metal salts and/or metal complexes are selected from the group of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$, and mixtures thereof, so that the metal salts and/or metal complexes selected from the group of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ are used with particular preference.

These metal salts or metal complexes are generally commercial substances which can be used in the washing or cleaning compositions for the purposes of silver corrosion protection without prior cleaning. For example, the mixture of penta- and tetravalent vanadium ($V_2O_5$, $VO_2$, $V_2O_4$) known from the preparation of $SO_3$ (contact process) is therefore suitable, as is the titanyl sulfate, $TiOSO_4$, which is obtained by diluting a $Ti(SO_4)_2$ solution.

The inorganic redox-active substances, especially metal salts or metal complexes, are preferably coated, i.e., covered completely with a material which is water-tight, but slightly soluble at the cleaning temperatures, in order to prevent their premature disintegration or oxidation in the course of storage. Preferred coating materials which are applied by known methods, for instance by the melt coating method according to Sandwik from the foods industry, are paraffins, micro waxes, waxes of natural origin, such as carnauba wax, candelilla wax, beeswax, relatively high-melting alcohols, for example, hexadecanol, soaps or fatty acids. The coating material which is solid at room temperature is applied to the material to be coated in the molten state, for example, by centrifuging finely divided material to be coated in a continuous stream through a likewise continuously generated spray-mist zone of the molten coating material. The melting point has to be selected such that the coating material readily dissolves or rapidly melts during the silver treatment. The melting point should ideally be in the range between 45° C. and 65° C. and preferably in the 50° C. to 60° C. range.

The metal salts and/or metal complexes mentioned are present in cleaning compositions preferably in an amount of from 0.05 to 6% by weight, preferably from 0.2 to 2.5% by weight, based in each case on the overall composition containing corrosion inhibitor.

Disintegration Assistants.

In order to ease the decomposition of prefabricated tablets, it is possible to incorporate disintegration assistants, known as tablet disintegrants, into these compositions, in order to shorten disintegration times. According to Römpp (9th edition, vol. 6, p. 4440) and Voigt "Lehrbuch der pharmazeutischen Technologie" [Textbook of pharmaceutical technology] (6th edition, 1987, p. 182-184), tablet disintegrants or disintegration accelerants refer to assistants which ensure the rapid decomposition of tablets in water or gastric juice and the release of pharmaceuticals in absorbable form.

These substances, which are also referred to as "breakup" agents owing to their action, increase their volume on ingress of water, and it is either the increase in the intrinsic volume (swelling) or the release of gases that can generate a pressure that causes the tablets to disintegrate into smaller particles. Disintegration assistants which have been known for some time are, for example, carbonate/citric acid systems, although other organic acids may also be used. Swelling disintegration assistants are, for example, synthetic polymers such as polyvinylpyrrolidone (PVP) or natural polymers or modified natural substances such as cellulose and starch and derivatives thereof, alginates or casein derivatives.

Preference is given to using disintegration assistants in amounts of from 0.5 to 10% by weight, preferably from 3 to 7% by weight and in particular from 4 to 6% by weight, based in each case on the total weight of the composition comprising disintegration assistant.

The preferred disintegration assistants used are disintegration assistants based on cellulose, so that preferred washing and cleaning compositions contain such a cellulose-based disintegration assistant in amounts of from 0.5 to 10% by weight, preferably from 3 to 7% by weight and in particular from 4 to 6% by weight. Pure cellulose has the formal empirical composition $(C_6H_{10}O_5)_n$ and, viewed in a formal sense, is a β-1,4-polyacetal of cellobiose which is in turn formed from two molecules of glucose. Suitable celluloses consist of from approximately 500 to 5,000 glucose units and accordingly have average molar masses of from 50,000 to 500,000. Useful cellulose-based disintegration assistants in the context of the present invention are also cellulose derivatives which are obtainable by polymer-like reactions from cellulose. Such chemically modified celluloses comprise, for example, products of esterifications and etherifications in which hydroxyl hydrogen atoms have been substituted. However, celluloses in which the hydroxyl groups have been replaced by functional groups which are not bonded via an oxygen atom can also be used as cellulose derivatives. The group of the cellulose derivatives includes, for example, alkali metal celluloses, carboxymethylcellulose (CMC), cellulose esters and ethers, and amino celluloses. The cellulose derivatives mentioned are preferably not used alone as disintegration assistants based on cellulose, but rather in a mixture with cellulose. The content of cellulose derivatives in these mixtures is preferably below 50% by weight, more preferably below 20% by weight, based on the disintegration assistant based on cellulose. The disintegration assistant based on cellulose which is used is more preferably pure cellulose which is free of cellulose derivatives.

The cellulose used as a disintegration assistant is preferably not used in finely divided form, but rather converted to a coarser form before admixing with the premixtures to be compressed, for example, granulated or compacted. The particle sizes of such disintegration assistants are usually above 200 μm, preferably to an extent of at least 90% by weight between 300 and 1,600 μm and in particular to an extent of at least 90% by weight between 400 and 1,200 μm. The aforementioned coarser cellulose-based disintegration assistants which are described in detail in the documents cited are to be used with preference as disintegration assistants in the context of the present invention and are commercially available, for example, under the name Arbocel® TF-30-HG from Rettenmaier.

As a further cellulose-based disintegration assistant or as a constituent of this component, it is possible to use microcrystalline cellulose. This microcrystalline cellulose is obtained by partial hydrolysis of celluloses under conditions which attack and fully dissolve only the amorphous regions (approximately 30% of the total cellulose mass) of the celluloses, but leave the crystalline regions (approximately 70%) undamaged. A subsequent deaggregation of the microfine celluloses formed by the hydrolysis affords the microcrystalline celluloses which have primary particle sizes of approximately 5 μm and can be compacted, for example, to granules having an average particle size of 200 μm.

Preferred disintegration assistants, preferably a cellulose-based disintegration assistant, preferably in granulated, cogranulated or compacted form, are present in the compositions containing disintegration assistant in amounts of from 0.5 to 10% by weight, preferably from 3 to 7% by weight and in particular from 4 to 6% by weight, based in each case on the total weight of the composition containing disintegration assistant.

According to the invention, gas-evolving effervescent systems may preferably additionally be used as tablet disintegration assistants. The gas-evolving effervescent system may consist of a single substance which releases a gas on contact with water. Among these compounds, mention should be made of magnesium peroxide in particular, which releases oxygen on contact with water. Typically, however, the gas-releasing effervescent system itself consists of at least two constituents which react with one another to form gas. While a multitude of systems which release, for example, nitrogen, oxygen or hydrogen are conceivable and practicable here, the effervescent system used in the washing and cleaning compositions will be selectable on the basis of both economic and on the basis of environmental considerations. Preferred effervescent systems consist of alkali metal carbonate and/or alkali metal hydrogencarbonate and of an acidifier which is suitable for releasing carbon dioxide from the alkali metal salts in aqueous solution.

In the case of the alkali metal carbonates and/or alkali metal hydrogencarbonates, the sodium and potassium salts are distinctly preferred over the other salts for reasons of cost. It is of course not mandatory to use the pure alkali metal carbonates or alkali metal hydrogencarbonates in question; rather, mixtures of different carbonates and hydrogencarbonates may be preferred.

The effervescent system used is preferably from 2 to 20% by weight, preferably from 3 to 15% by weight and in particular from 5 to 10% by weight of an alkali metal carbonate or alkali metal hydrogencarbonate, and from 1 to 15% by weight, preferably from 2 to 12% by weight and in particular from 3 to 10% by weight of an acidifier, based in each case on the overall weight of the composition.

Acidifiers which release carbon dioxide from the alkali metal salts in aqueous solution and can be used are, for example, boric acid and also alkali metal hydrogensulfates, alkali metal dihydrogenphosphates and other inorganic salts. Preference is given, however, to the use of organic acidifiers, citric acid being a particularly preferred acidifier. However, it is also possible, in particular, to use the other solid mono-, oligo- and polycarboxylic acids. From this group, preference is given in turn to tartaric acid, succinic acid, malonic acid, adipic acid, maleic acid, fumaric acid, oxalic acid, and polyacrylic acid. It is likewise possible to use organic sulfonic acids such as amidosulfonic acid. A commercially available acidifier which can likewise be used with preference in the context of the present invention is Sokalan® DCS (trademark of BASF), a mixture of succinic acid (maxium 31% by weight), glutaric acid (maxium 50% by weight) and adipic acid (maxium 33% by weight).

Preference is given to acidifiers in the effervescent system from the group of the organic di-, tri- and oligocarboxylic acids, or mixtures of these.

Fragrances.

In the context of the present invention, the perfume oils and/or fragrances used may be individual odorant compounds, for example, the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methyl phenylglycinate, allyl cyclohexylpropionate, styrallyl propionate and benzyl salicylate. The ethers include, for example, benzyl ethyl ether; the aldehydes include, for example, the linear alkanals having 8-18 carbon atoms, citral, citronellal, citronellyloxy-acetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol and terpineol; the hydrocarbons include primarily the terpenes such as limonene and pinene. However, preference is given to using mixtures of different odorants which together produce a pleasing fragrance note. Such perfume oils may also comprise natural odorant mixtures, as are obtainable from vegetable sources, for example, pine oil, citrus oil, jasmine oil, patchouli oil, rose oil or ylang-ylang oil. Likewise suitable are muscatel, sage oil, camomile oil, clove oil, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

The general description of the perfumes which can be used (see above) is a general representation of the different classes of odorant substances. In order to be perceptible, an odorant must be volatile, for which an important role is played not only by the nature of the functional groups and by the structure of the chemical compound but also by the molar mass. Thus, the majority of odorants have molar masses of up to about 200 daltons, while molar masses of 300 daltons or more tend to be an exception. On the basis of the different volatility of odorants there is a change in the odor of a perfume or fragrance composed of two or more odorants during its evaporation, and the perceived odors are divided into top note, middle note or body, and end note or dryout. Since the perception of odor is to a large extent also based on the odor intensity, the top note of a perfume or fragrance does not consist only of volatile compounds, whereas the end note consists for the most part of less volatile odorants, i.e., odorants which adhere firmly. In the composition of perfumes it is possible for more volatile odorants, for example, to be bound to certain fixatives, which prevent them from evaporating too rapidly. The subsequent classification of the odorants into "more volatile" and "firmly adhering" odorants, therefore, states nothing about the perceived odor and about whether the odorant in question is perceived as a top note or as a middle note.

Examples of firmly adhering odorants which can be used in the context of the present invention are the essential oils such as angelica root oil, anise oil, arnica blossom oil, basil oil, bay oil, bergamot oil, champaca blossom oil, noble fir oil, noble fir cone oil, elemi oil, eucalyptus oil, fennel oil, spruce needle oil, galbanum oil, geranium oil, ginger grass oil, guaiacwood oil, gurjun balsam oil, *helichrysum* oil, ho oil, ginger oil, iris oil, cajeput oil, calamus oil, camomile oil, camphor oil, canaga oil, cardamom oil, *cassia* oil, pine needle oil, copaiva balsam oil, coriander oil, spearmint oil, caraway oil, cumin oil, lavender oil, lemon grass oil, lime oil, mandarin oil, balm oil, musk seed oil, myrrh oil, clove oil, neroli oil, niaouli oil, olibanum oil, orange oil, *origanum* oil, palmarosa oil, patchouli oil, peru balsam oil, petitgrain oil, pepper oil, peppermint oil, pimento oil, pine oil, rose oil, rosemary oil, sandalwood oil, celery oil, spike oil, star anise oil, turpentine oil, *thuja* oil, thyme oil, verbena oil, vetiver oil, juniperberry oil, wormwood oil, wintergreen oil, ylang-ylang oil, hyssop oil, cinnamon oil, cinnamon leaf oil, citronella, lemon oil and cypress oil. However, the higher-boiling or solid odorants of natural or synthetic origin may also be used in the context of the present invention as firmly adhering odorants or odorant mixtures, i.e., fragrances. These compounds include the following compounds and mixtures thereof: ambrettolide, α-amylcinnamaldehyde, anethole, anisaldehyde, anisyl alcohol, anisole, methyl anthranilate, acetophenone, benzylacetone, benzaldehyde, ethyl benzoate, benzophenone, benzyl alcohol, benzyl acetate, benzyl benzoate, benzyl formate, benzyl valerate, borneol, bornyl acetate, α-bromostyrene, n-decylaldehyde, n-dodecylaldehyde, eugenol, eugenol methyl ether, eucalyptol, farnesol, fenchone, fenchyl acetate, geranyl acetate, geranyl formate, heliotropin, methyl heptynecarboxylate, heptaldehyde, hydroquinone dimethyl ether, hydroxycinnamaldehyde, hydroxycinnamyl alcohol, indole, iron, isoeugenol, isoeugenol methyl ether, isosafrol, jasmone, camphor, carvacrol, carvone, p-cresol methyl ether, coumarin, p-methoxyacetophenone, methyl n-amyl ketone, methyl methylanthranilate, p-methylacetophenone, methylchavicol, p-methylquinoline, methyl β-naphthyl ketone, methyl-n-nonylacetaldehyde, methyl n-nonyl ketone, muscone, β-naphthol ethyl ether, β-naphthol methyl ether, nerol, nitrobenzene, n-nonylaldehyde, nonyl alcohol, n-octylaldehyde, p-oxyacetophenone, pentadecanolide, β-phenylethyl alcohol, phenylacetaldehyde dimethyl acetal, phenylacetic acid, pulegone, safrol, isoamyl salicylate, methyl salicylate, hexyl salicylate, cyclohexyl salicylate, santalol, skatole, terpineol, thymene, thymol, γ-undecalactone, vanillin, veratrum aldehyde, cinnamaldehyde, cinnamyl alcohol, cinnamic acid, ethyl cinnamate, benzyl cinnamate. The more volatile odorants include in particular the lower-boiling odorants of natural or synthetic origin, which may be used alone or in mixtures. Examples of more volatile odorants are alkyl isothiocyanates (alkyl mustard oils), butanedione, limonene, linalool, linalyl acetate and linalyl propionate, menthol, menthone, methyl-n-heptenone, phellandrene, phenylacetaldehyde, terpinyl acetate, citral, citronellal.

The fragrances can be processed directly, but it may also be advantageous to apply the fragrances to carriers which ensure long-lasting fragrance by slower fragrance release. Useful such carrier materials have been found to be, for example, cyclodextrins, and the cyclodextrin-perfume complexes may additionally also be coated with further assistants.

Dyes.

Preferred dyes, whose selection presents no difficulty at all to the person skilled in the art, have high storage stability and insensitivity toward the other ingredients of the compositions and to light, and also have no pronounced substantivity toward the substrates to be treated with the dye-containing compositions, such as textiles, glass, ceramic or plastic dishware, so as not to stain them.

In the selection of the colorant, it has to be ensured that the colorants, in the case of textile washing compositions, do not have too strong an affinity toward the textile surfaces and here in particular toward synthetic fibers, while, in the case of cleaning compositions, too strong an affinity toward glass, ceramic or plastic dishware has to be avoided. At the same time, it should be taken into account when selecting suitable colorants that colorants have different stabilities toward oxidation. It is generally the case that water-insoluble colorants are more stable toward oxidation than water-soluble colorants. The concentration of the colorant in the washing or cleaning compositions varies depending on the solubility and hence also upon the oxidation sensitivity. In the case of highly water-soluble colorants, for example, the above-mentioned Basacid® Green or the likewise above-mentioned Sandolan® Blue, typical colorant concentrations in the region of a few $10^{-2}$ to $10^{-3}$% by weight are selected. In the case of the pigmentary dyes, which are especially preferred owing to their brilliance but are less readily water-soluble, for example, the above-mentioned Pigmosol® dyes, the suitable concentration of the colorant in washing or cleaning compositions, in contrast, is typically a few $10^{-3}$ to $10^{-4}$% by weight.

Preference is given to colorants which can be destroyed oxidatively in the washing process, and to mixtures thereof with suitable blue dyes, known as bluing agents. It has been found to be advantageous to use colorants which are soluble in water or, at room temperature, in liquid organic substances. Examples of suitable colorants are anionic colorants, for example, anionic nitroso dyes. One example of a possible colorant is naphthol green (Color Index (Cl) Part 1: Acid Green 1; Part 2: 10020), which is available as a commercial product, for example, as Basacid® Green 970 from BASF, Ludwigshafen, Germany, and mixtures thereof with suitable blue dyes. Further suitable colorants are Pigmosol® Blue 6900 (C174160), Pigmosol® Green 8730 (Cl74260), Basonyl® Red 545 FL (C145170), Sandolan® Rhodamin EB400 (Cl45100), Basacid® Yellow 094 (Cl47005), Sicovit® Patent Blue 85 E 131 (Cl42051), Acid Blue 183 (CAS 12217-22-0, Cl Acid Blue 183), Pigment Blue 15 (Cl74160), Supranol® Blue GLW (CAS 12219-32-8, Cl Acid Blue 221)), Nylosan® Yellow N-7GL SGR(CAS 61814-57-1, Cl Acid Yellow 218) and/or Sandolan® Blue (Cl Acid Blue 182, CAS 12219-26-0).

In addition to the components described in detail so far, the washing and cleaning compositions may comprise further ingredients which further improve the performance and/or esthetic properties of these compositions. Preferred compositions comprise one or more substances from the group of electrolytes, pH modifiers, fluorescers, hydrotropes, foam inhibitors, silicone oils, antiredeposition agents, optical brighteners, graying inhibitors, shrink preventatives, anticrease agents, dye transfer inhibitors, active antimicrobial ingredients, germicides, fungicides, antioxidants, antistats, ironing aids, repellency and impregnation agents, antiswell and antislip agents and UV absorbers.

The electrolytes used from the group of the inorganic salts may be a wide range of highly varying salts. Preferred cations are the alkali metals and alkaline earth metals; preferred anions are the halides and sulfates. From a production point of view, preference is given to the use of NaCl or $MgCl_2$ in the washing or cleaning compositions.

In order to bring the pH of the washing or cleaning compositions into the desired range, it may be appropriate to use pH modifiers. It is possible here to use all known acids or alkalis, as long as their use is not forbidden on performance or ecological grounds or on grounds of consumer protection. Typically, the amount of these modifiers does not exceed 1% by weight of the overall formulation.

Useful foam inhibitors include soaps, oils, fats, paraffins or silicone oils, which may optionally be applied to support materials. Suitable support materials are, for example, inorganic salts such as carbonates or sulfates, cellulose derivatives or silicates and mixtures of the aforementioned materials. Compositions which are preferred in the context of the present application comprise paraffins, preferably unbranched paraffins (n-paraffins) and/or silicones, preferably linear polymeric silicones which have the composition according to the scheme $(R_2SiO)x$ and are also referred to as silicone oils. These silicone oils are commonly clear, colorless, neutral, odorless, hydrophobic liquids having a molecular weight between 1,000 and 150,000, and viscosities between 10 and 1,000,000 mPa·s.

Suitable antiredeposition agents, which are also referred to as soil repellents, are, for example, nonionic cellulose ethers, such as methylcellulose and methylhydroxypropyl-cellulose having a proportion of methoxy groups of from 15 to 30% by weight and of hydroxypropyl groups of from 1 to 15% by weight, based in each case on the nonionic cellulose ethers, and the prior art polymers of phthalic acid and/or terephthalic acid or derivatives thereof, in particular polymers of ethylene terephthalates and/or polyethylene glycol terephthalates or anionically and/or nonionically modified derivatives thereof. Among these, particular preference is given to the sulfonated derivatives of phthalic acid polymers and terephthalic acid polymers.

Optical brighteners (known as "whiteners") may be added to the washing or cleaning compositions in order to eliminate graying and yellowing of the treated textiles. These substances attach to the fibers and bring about brightening and simulated bleaching action by converting invisible ultraviolet radiation to visible longer-wavelength light, in the course of which the ultraviolet light absorbed from sunlight is radiated as pale bluish fluorescence and, together with the yellow shade of the grayed or yellowed laundry, results in pure white. Suitable compounds stem, for example, from the substance classes of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazole, benzisoxazole and benzimidazole systems, and the pyrene derivatives substituted by heterocycles.

Graying inhibitors have the task of keeping the soil detached from the fiber suspended in the liquor, thus preventing the soil from reattaching. Suitable for this purpose are water-soluble colloids, usually of organic nature, for example, the water-soluble salts of polymeric carboxylic acids, size, gelatin, salts of ether sulfonic acids of starch or of cellulose, or salts of acidic sulfuric esters of cellulose or of starch. Water-soluble polyamides containing acidic groups are also suitable for this purpose. In addition, it is possible to use soluble starch preparations, and starch products other than those mentioned above, for example, degraded starch, aldehyde starches, etc. It is also possible to use polyvinylpyrrolidone. Also usable as graying inhibitors are cellulose ethers such as carboxymethylcellulose (sodium salt), methylcellulose, hydroxyalkylcellulose and mixed ethers such as methylhydroxyethylcellulose, methylhydroxypropylcellulose, methylcarboxymethylcellulose and mixtures thereof.

Since textile fabrics, in particular those made of rayon, viscose, cotton and mixtures thereof, can tend to crease because the individual fibers are sensitive toward bending, folding, compressing and crushing transverse to the fiber direction, synthetic anticrease agents may be used. These include, for example, synthetic products based on fatty acids, fatty acid esters, fatty acid amides, fatty acid alkylol esters, fatty acid alkylolamides or fatty alcohols, which have usually been reacted with ethylene oxide, or products based on lecithin or modified phosphoric esters.

Repellency and impregnation processes serve to finish textiles with substances which prevent the deposition of soil or make it easier to wash out. Preferred repellency and impregnating agents are perfluorinated fatty acids, also in the form of their aluminum and zirconium salts, organic silicates, silicones, polyacrylic esters having a perfluorinated alcohol component or polymerizable compounds having a coupled, perfluorinated acyl or sulfonyl radical. Antistats may also be present. The soil-repellent finish with repellency and impregnating agents is often classified as an easycare finish. The penetration of the impregnating agents in the form of solutions or emulsions of the active ingredients in question may be eased by adding wetting agents which lower the surface tension. A further field of use of repellency and impregnating agents is the water-repellent finishing of textiles, tents, tarpaulins, leather, etc., in which, in contrast to waterproofing, the fabric pores are not sealed and the substance thus remains breathable (hydrophobizing). The hydrophobizing agents used for the hydrophobization coat textiles, leather, paper, wood, etc., with a very thin layer of hydrophobic groups such as relatively long alkyl chains or siloxane groups. Suitable hydrophobizing agents are, for example, paraffins, waxes, metal soaps, etc., with additives of aluminum or zirconium salts, quaternary ammonium compounds having long-chain alkyl radicals, urea derivatives, fatty acid-modified melamine resins, chromium complex salts, silicones, organotin compounds and glutaraldehyde, and also perfluorinated compounds. The hydrophobized materials do not have a greasy feel, but water drops, similarly to the way they do on greased substances, run off them without wetting them. For example, silicone-impregnated textiles have a soft hand and are water- and soil-repellant; stains of ink, wine, fruit juices and the like can be removed more easily.

Active antimicrobial ingredients can be used to control microorganisms. A distinction is drawn here, depending on the antimicrobial spectrum and mechanism of action, between bacteriostats and bactericides, fungistats and fungicides, etc. Important substances from these groups are, for example, benzalkonium chlorides, alkylarylsulfonates, halophenols and phenylmercuric acetate, although it is also possible to dispense entirely with these compounds.

In order to prevent undesired changes, caused by the action of oxygen and other oxidative processes, to the washing and cleaning compositions and/or the textiles treated, the compositions may comprise antioxidants. This class of compound includes, for example, substituted phenols, hydroquinones, pyrocatechols and aromatic amines, and also organic sulfides, polysulfides, dithiocarbamates, phosphites and phosphonates.

Increased wear comfort can result from the additional use of antistats. Antistats increase the surface conductivity and thus permit improved discharge of charges formed. External antistats are generally substances having at least one hydrophilic molecular ligand and impart to the surfaces a more or less hygroscopic film. These usually interface-active antistats can be subdivided into nitrogen antistats (amines, amides, quaternary ammonium compounds), phosphorus antistats (phosphoric esters) and sulfur antistats (alkylsulfonates, alkyl sulfates). Lauryl- (or stearyl)dimethylbenzylammonium chlorides are likewise suitable as antistats for textiles or as additives for washing compositions, in which case a softening effect is additionally achieved.

For the care of the textiles and for an improvement in the textile properties such as a softer "hand" (softening) and reduced electrostatic charge (increased wear comfort), fabric softeners may be used. The active ingredients in fabric softener formulations are ester quats, quaternary ammonium compounds having two hydrophobic radicals, for example, distearyldimethylammonium chloride which, however, owing to its inadequate biodegradability, is increasingly being replaced by quaternary ammonium compounds which contain ester groups in their hydrophobic radicals as intended cleavage sites for biodegradation.

Such ester quats having improved biodegradability are obtainable, for example, by esterifying mixtures of methyldiethanolamine and/or triethanolamine with fatty acids and subsequently quaternizing the reaction products with alkylating agents in a manner known per se. Another suitable finish is dimethylolethyleneurea.

To improve the water-absorption capacity and the rewettability of the treated textiles, and to ease the ironing of these textiles, it is possible to use silicone derivatives. They additionally improve the rinse-out performance of the washing or cleaning compositions by virtue of their foam-inhibiting properties. Preferred silicone derivatives are, for example, polydialkyl- or alkylarylsiloxanes in which the alkyl groups have from one to five carbon atoms and are fully or partly fluorinated. Preferred silicones are polydimethylsiloxanes which may optionally be derivatized and are in that case amino-functional or quaternized or have Si—OH, Si—H and/or Si—Cl bonds. Further preferred silicones are the polyalkylene oxide-modified polysiloxanes, i.e., polysiloxanes which have polyethylene glycols, for example, and the polyalkylene oxide-modified dimethyl polysiloxanes.

Finally, it is also possible in accordance with the invention to use UV absorbers which attach to the treated textiles and improve the photoresistance of the fibers. Compounds which have these desired properties are, for example, the compounds and derivatives of benzophenone having substituents in the 2- and/or 4-position which are active by virtue of radiationless deactivation. Also suitable are substituted benzotriazoles, 3-phenyl-substituted acrylates (cinnamic acid derivatives), optionally having cyano groups in the 2-position, salicylates, organic nickel complexes and natural substances such as umbelliferone and endogenous urocanic acid.

Owing to their fibercare action, protein hydrolyzates are further preferred active substances from the field of washing and cleaning compositions in the context of the present invention. Protein hydrolyzates are product mixtures which are obtained by acid-, base- or enzyme-catalyzed degradation of proteins. According to the invention, protein hydrolyzates either of vegetable or animal origin may be used. Animal protein hydrolyzates are, for example, elastin, collagen, keratin, silk and milk protein hydrolyzates which may also be present in the form of salts. Preference is given in accordance with the invention to the use of protein hydrolyzates of vegetable origin, for example, soybean, almond, rice, pea, potato and wheat protein hydrolyzates. Although preference is given to the use of the protein hydrolyzates as such, it is in some cases also possible to use in their stead amino acid mixtures or individual amino acids obtained in other ways, for example. arginine, lysine, histidine or pyroglutamic acid. It is likewise possible to use derivatives of protein hydrolyzates, for example, in the form of their fatty acid condensates.

The nonaqueous solvents which can be used in accordance with the invention include in particular the organic solvents, of which only the most important can be listed here: alcohols (methanol, ethanol, propanols, butanols, octanols, cyclohexanol), glycols (ethylene glycol, diethylene glycol), ethers and glycol ethers (diethyl ether, dibutyl ether, anisole, dioxane, tetrahydrofuran, mono-, di-, tri-, polyethylene glycol ethers), ketones (acetone, butanone, cyclohexanone), esters (ethyl acetate, glycol esters), amides and other nitrogen compounds (dimethylformamide, pyridine, N-methylpyrrolidone, acetonitrile), sulfur compounds (carbon disulfide, dimethyl sulfoxide, sulfolane), nitro compounds (nitrobenzene), halohydrocarbons (dichloromethane, chloroform, tetrachloromethane, tri-, tetrachloroethene, 1,2-dichloroethane, chlorofluorocarbons), hydrocarbons (benzines, petroleum ether, cyclohexane, methylcyclohexane, decalin, terpene solvents, benzene, toluene, xylenes). Alternatively, it is also possible instead of the pure solvents to use mixtures thereof which, for example, advantageously combine the dissolution properties of different solvents. Such a solvent mixture which is particularly preferred in the context of the present application is, for example, petroleum benzine, a mixture of different hydrocarbons which is suitable for chemical purification, preferably having a content of C12 to C14 hydrocarbons above 60% by weight, more preferably above 80% by weight and in particular above 90% by weight, based in each case on the total weight of the mixture, preferably having a boiling range of from 81 to 110° C.

The invention claimed is:

1. A triphasic or multiphasic dosage unit for washing or cleaning compositions, comprising at least two washing or cleaning composition shaped bodies, each of which has at least one filled cavity, characterized in that the shaped bodies comprise two ring tablets which are adhesively bonded to one another along their bottom faces to form a combined ring tablet wherein two cavities which are differently filled are separated by a water-soluble film, further characterized in that at least one cavity is filled with a liquid.

2. The dosage unit as claimed in claim 1, characterized in that the shaped bodies are compacted, tableted, extruded or cast shaped bodies.

3. The dosage unit as claimed in claim 2, wherein the shaped bodies are tableted bodies.

4. The dosage unit as claimed in claim 1, characterized in that the shaped bodies are adhesively bonded to one another by means of an adhesive.

5. The dosage unit as claimed in claim 4, wherein the adhesive is a solvent.

6. The dosage unit as claimed in claim 4, wherein the adhesive is an organic polymer.

7. The dosage unit as claimed in claim 4, wherein the adhesive is a hotmelt adhesive.

8. The dosage unit as claimed in claim 7, wherein the hotmelt adhesive comprises a) 40 to 70% by weight of at least one homo- or co-polymer with free carboxylic acid groups based on ethylenically unsaturated monomers, b) from 15 to 45% by weight of at least one water-soluble or water-dispersible polyurethane, c) from 10 to 45% by weight of at least one inorganic or organic base, and d) from 0 to 20% by weight of further additives, the sum of the components adding up to 100% by weight.

9. The dosage unit as claimed in claim 1, characterized in that the adhesive comprises one or more water-soluble polymers.

10. The dosage unit as claimed in claim 1, characterized in that at least one cavity is filled with a free-flowing substance.

11. The dosage unit as claimed in claim 10, wherein the free-flowing substance is a particulate substance.

12. The dosage unit as claimed in claim 11, wherein the particulate substance has a particle size of between 100 and 800 μm.

13. The dosage unit as claimed in claim 1, characterized in that at least one cavity is sealed.

14. A triphasic or multiphasic dosage unit for washing or cleaning compositions, comprising at least two washing or cleaning composition shaped bodies, each of which has at least one filled cavity, characterized in that the shaped bodies comprise two ring tablets which are adhesively bonded to one another along their bottom faces to form a combined ring tablet wherein two cavities which are differently filled are separated by a water-soluble film and at least one of the cavities is an aperture, and further characterized in that at least one cavity is filled with a liquid.

15. The dosage unit as claimed in claim 14, wherein the volume of the cavities is between 0.1 and 20 ml.

16. The dosage unit as claimed in claim 14, wherein the volume of the cavities is between 1 and 10 ml.

17. A triphasic or multiphasic tablet for washing or cleaning compositions, comprising at least two washing or cleaning composition shaped bodies, each of which has at least one filled cavity, characterized in that the shaped bodies comprise two ring tablets which are adhesively bonded to one another along their bottom faces to form a combined ring tablet wherein the tablet has layers and wherein two cavities which are differently filled are separated by a water-soluble film, and further characterized in that at least one cavity is filled with a liquid.

18. The tablet as claimed in claim 17, wherein the weight ratio of the layer with the lowest proportion by weight of the tablet is preferably at least 10% by weight and the layer with the highest proportion by weight of the tablet is between 55 and 70% by weight.

19. The tablet of claim 17, wherein the tablet has an onion-skin-like structure, wherein at least one inner layer is surrounded completely by one outer layer.

* * * * *